US011096005B2

(12) United States Patent
Mitchell et al.

(10) Patent No.: US 11,096,005 B2
(45) Date of Patent: Aug. 17, 2021

(54) SOUND REPRODUCTION

(71) Applicant: Audio Analytic LTD, Cambridgeshire (GB)

(72) Inventors: Christopher James Mitchell, Cambridgeshire (GB); Sacha Krstulovic, Cambridgeshire (GB); Thomas Grainge, Cambridgeshire (GB)

(73) Assignee: Audio Analytic Ltd.

( * ) Notice: Subject to any disclaimer, the term of this patent is extended or adjusted under 35 U.S.C. 154(b) by 0 days.

(21) Appl. No.: 16/635,788

(22) PCT Filed: Jul. 31, 2018

(86) PCT No.: PCT/GB2018/052189
§ 371 (c)(1),
(2) Date: Jan. 31, 2020

(87) PCT Pub. No.: WO2019/025789
PCT Pub. Date: Feb. 7, 2019

(65) Prior Publication Data

US 2020/0329330 A1 Oct. 15, 2020

Related U.S. Application Data

(60) Provisional application No. 62/540,287, filed on Aug. 2, 2017.

(51) Int. Cl.
*H04S 7/00* (2006.01)
*H04R 3/00* (2006.01)
*H04R 5/02* (2006.01)

(52) U.S. Cl.
CPC ..... *H04S 7/303* (2013.01); *H04R 3/005* (2013.01); *H04R 5/02* (2013.01); *H04S 7/301* (2013.01); *H04S 2400/01* (2013.01)

(58) Field of Classification Search
CPC ..... H04R 3/005; H04R 5/02; H04S 7/301; H04S 7/303; H04S 2400/01
See application file for complete search history.

(56) References Cited

U.S. PATENT DOCUMENTS

| | | | | |
|---|---|---|---|---|
| 8,670,850 | B2 | 3/2014 | Soulodre | |
| 2006/0222182 | A1 | 10/2006 | Nakaishi et al. | |
| 2010/0322438 | A1* | 12/2010 | Siotis ..... | H03G 3/007 381/98 |

OTHER PUBLICATIONS

Beritelli, et al., "A pattern recognition system for environmental sound classification based on MFCCs and neural networks", Signal Processing and Communication Systems, 2008. ICSPCS 2008. 2nd International Conference on, IEEE, Piscataway, NJ, USA, Dec. 15, 2008, pp. 1-4, XP031448725, ISBN: 978-1-4244-4243-0, p. 2, right-hand column, lines 10-23.

(Continued)

*Primary Examiner* — Regina N Holder
(74) *Attorney, Agent, or Firm* — Tarolli, Sundheim, Covell & Tummino LLP

(57) ABSTRACT

A method, and system, of digital room correction for a device, such as a smart speaker, including a loudspeaker. The method comprises capturing audio from an environment local to the device, for example from one or more microphones of a smart speaker. The captured audio is then processed to recognize one or more categories of sound. A digital room correction procedure may then be controlled dependent upon recognition and/or analysis of at least one of the categories of sound.

14 Claims, 9 Drawing Sheets

(56) References Cited

OTHER PUBLICATIONS

International Search Report for international Application No. PCT/GB2018/052189 dated Dec. 7, 2018.

* cited by examiner

SOUND REPRODUCTION

RELATED APPLICATIONS

The present invention is a U.S. National Stage under 35 USC 371 patent application, claiming priority to Serial No. PCT/GB2018/052189, filed on 31 Jul. 2018; which claims priority of U.S. 62/540,287, filed on 2 Aug. 2017, the entirety of both of which are incorporated herein by reference.

FIELD OF THE INVENTION

This invention relates to improvements to portable speakers such as smart speakers, and to other devices including loudspeakers.

BACKGROUND TO THE INVENTION

There is a general desire to improve the user experience of sound reproduction from a variety of devices such as portable speakers, smart speakers, mobile devices such as mobile phones, and tablets, laptops and personal computers, sound bars, televisions and the like.

In the context of this specification a smart speaker is typically a wireless/internet connected device including at least one speaker (generally an array of speakers) and at least one microphone (generally multiple microphones), and providing some voice-control functionality. In this way, as well as audio playback, the smart speaker can be used for functions such as music selection, shopping, and other functions provided by digital or virtual personal assistants.

SUMMARY OF THE INVENTION

The inventors have realized that understanding the sound environment in the room or other location of a speaker can assist the user experience of sound, for example music, reproduction. The following aspects of the methods/systems we describe may be employed particularly advantageously in smart speakers, but more generally they can be used with any device including a loudspeaker and which has an associated microphone.

Thus in one aspect there is provided a method, and system, of digital room correction for a device including a loudspeaker. The method comprises capturing audio from an environment local to the device, for example from one or more microphones of a smart speaker. The captured audio is then processed to recognize one or more categories of sound. A digital room correction procedure may then be controlled dependent upon recognition and/or analysis of at least one of the categories of sound.

The recognized categories of sound may include one or more categories such as speech, music, and singing; and/or one or more categories relating to human activities such as cooking, watching television, eating, partying, and so forth; and/or one or more categories typical of sounds in particular rooms such as a kitchen, living room, bedroom, children's room, dining room and so forth. In this latter case the recognized sounds may be sounds characteristic of a background sound level in a room. More generally the categories may comprise one or more of human-generated sounds, animal-generated sounds, mechanical sounds, musical sounds, and environmental sounds; and/or sub-categories thereof. Typically, but not essentially, the recognized categories of sound comprise sounds recognized to be present (on average, not necessarily continually) for an extended period of time, for example greater than 1, 5, 10, 30 or 60 minutes. We describe later some examples of sound recognition which may be employed in the method/system but the skilled person will be aware that there are many techniques which may be used to identify or classify sounds, typically machine learning techniques.

In broad terms, digital room correction may comprise a procedure involving digital filtering to lessen unwanted acoustic characteristics of a room on which a speaker is located. For example a naive approach may estimate an impulse or other response of a room and then apply an inverse of this to attempt to flatten the room response. However this can result in a correction which is optimized for a particular location in the room. A more sophisticated approach may apply a filter which creates an improved response over a larger volume, at the expense of accuracy at a point. In addition, psychoacoustically a flat response does not always sound the best, although this can be a matter of taste. The skilled person will be aware of many different techniques which may be employed to implement a digital room correction procedure.

The recognized sound may be analyzed to infer one or more DRC and/or control parameters. The analysis may comprise, for example, processing a spectrum of the sound, for example to determine an averaged spectrum, and/or may comprise more sophisticated processing such as applying compressed sensing technique to characterize the sound. The results of the analysis may then be used to perform DRC and/or (as described below for other aspects) modification of a speaker response such as a dynamic compression response; and/or used in some other manner to modify the reproduced sound.

In the case of a smart speaker or other device controlled by a voice command the recognition may be part of a voice-control system of the device. In such a device processing implemented by the method may follow a voice recognition stage of existing processing in the device, for example a keyword detection or keyword wake-up stage/module. The skilled person will appreciate this this applies to all the aspects described herein. Such an implementation can be advantageous in providing some synergy with existing technology when incorporated into a device which already includes some form of local or remote (e.g. cloud-based) sound recognition, since this functionality may be re-used when implementing the presently-described techniques.

Thus in one approach a digital room correction procedure may comprise generating a sound with the loudspeaker and listening to, i.e. capturing with a microphone, the sound in the room. In such an approach the recognized sound category may be an interfering sound—which in this context may be any of the aforementioned categories such as speech, music and so forth. Then, when an interfering sound is recognized, operation of the digital room correction may be suppressed, for example by ceasing to capture the audio, muting the captured audio, ignoring or otherwise omitting to process the captured audio for a period when interference is detected and so forth.

In another approach the recognized sound (sound category) may itself be used to supplement and/or replace generation of a sound for the digital room correction. Thus a room response correction may be determined from a combination of a priori knowledge, such as a model, of characteristics of the recognized category of sound and captured audio for the sound. For example human speech is well-characterized so that if, say, male and/or female speech is recognized the captured audio from the microphone(s)

represents a modification of this speech which may be characterized and used to determine a room response correction. The same approach may be applied to other recognized sound categories. Alternatively a room response correction may be determined without using such a priori knowledge, for example by characterizing a spectrum of a recognized sound, for example by averaging the spectrum, or by compressed sensing, or in some other manner.

In one approach a set of one or more parameters of a model of the recognized sound, e.g. speech, may be compared or processed in combination with corresponding parameters of the captured audio to estimate a room response, in effect mapping the captured audio to a generic model of the sound (e.g. speech). The parameters may characterize the sound in terms of a distribution of frequencies (and their amplitudes) in the sound, optionally averaging these, then determining a room response which maps one into the other, and then optionally determining an inverse of this mapping. Optionally the technique of "compressed sensing" may be employed to take account of the incomplete observation of the sound signal that may result with this approach. For example a larger number of room correction parameters may be estimated than there are observations by recovering room response parameters from the sound data under a sparsity constraint which allows only a small number of non-zero coefficients.

In another approach, rather than recovering a room response explicitly the room response correction may be selected from a set of predetermined response corrections. The correction may be selected responsive to the recognized category of sound and/or the captured audio for the recognized category of sound. For example captured audio from a recognized sound may be classified into one of a plurality of room correction responses, which may be machine learnt. For example speech may be classified into, say, 1 of 5 response corrections which may then be selected dependent upon, in effect, how the captured speech sounds to the microphone(s). This may be generalized so that each category of recognized sound may have a corresponding set of one or more pre-determined or learned room response corrections which may be selected according to how the particular recognized sound is "heard", that is received by the microphone(s).

In another aspect there is described a method/system for controlling sound generation by a device including a loudspeaker which involves steering a sound. The method/system comprises capturing audio from an environment local to the device using one, two or more microphones associated with the device, and then processing the captured audio to recognize one or more categories of sound broadly as previously described. An estimated location of the recognized sound may then be determined, and sound from the loudspeaker steered based upon knowledge of this estimated location.

Preferably the recognized category of sound, say speech/cooking/a person moving around, comprises a sound different to the expected background, and here referred to as an anomalous sound. It has been found in practice that such anomalous sounds are typically associated with human activity, and thus by determining the approximate location of an anomalous sound, the approximate or guesstimated location of a person or people in the environment can be determined, and optionally tracked. Based upon this information the user experience of sound reproduction by the loudspeaker can be improved, as described further below.

A sound may be recognized "directly" and/or a sound may be recognized or categorized as anomalous based upon differentiating between the sound and the background. For example, the method/system may recognize just speech to determine an approximate location of a person. In practice, however, a more general approach involving recognition of activity has been found to better correlate with the location of a person.

Thus the method/system may also include adapting an audio processing module to differentiate between a background sound and an anomalous sound different to the background sound. Although in principle neural network-based machine learning may be employed, in practice it appears that this approach finds it difficult to learn background sounds which occur sporadically over relatively long periods of time, such as boilers and air conditioning switching on and off, and related/consequential sounds. Thus a better solution appears to be to capture a set of metrics for the sounds and then pass these into an audio scene analysis engine, which preferably includes a (finite) state machine. Suitable metrics can include a long-duration (seconds, minutes or longer) average sound energy measure, tonal energy characteristics of the sound, energies at different frequencies, and ratios thereof. The state machine and/or metrics may adapt to or learn the background, and hence can differentiate between the background and an anomalous sound, which is a sound different to the expected background. Additionally or alternatively the audio scene analysis engine may determine a score for each successive sound frame (interval), and build up a profile of the score over time. A discrete event may optionally be identified as anomalous dependent upon the score differing from the profile, which may be learned or adaptive.

The approximate location of a sound may be determined using time-of-flight and/or multiple microphones, for example triangulating to determine an approximate location for a recognized sound. Even where microphones are co-located, say in a smart speaker but pointing in different directions, an estimated location of a sound may be determined from differences in the audio captured from the two microphones, and location of the sound may be tracked.

Sound generated from the device may be steered in various ways. For example typically a smart speaker will include multiple speakers, for example a tweeter array sometimes with a single bass speaker. In such a case different frequencies/channels of the sound to be reproduced may be steered by phased array techniques.

In other cases there may not be a speaker array in which case an HRTF (Head-Related Transfer Function) may be used for steering; optionally both techniques may be employed. The human perception of sound location is influenced by the time taken for the wavefront of a sound to travel from one ear to another through the head. Thus by generating a mono sound which incorporates components with a similar time difference, which is heard by both ears, the brain can be fooled into thinking that a sound is coming from a different direction than the one it is actually coming from. By making a sound appear to come from multiple different directions the sound can be "thickened".

In a similar manner a speaker array may be used to steer a sound into one or multiple different directions. This may be employed to bounce sounds off the walls (the time delays involved are typically short and different to reverb—the reflections are early). This fills the room with sound, creating a rich, immersive experience or "thick" sound. This approach is different to stereo reproduction which reproduces a stereo image at a point.

There are various ways in which a sound recognition may be used to steer a sound. For example in one approach recognizing a sound provides information about the sound environment—that there is a party going on, for example, so that many people may lack line-of-sight to the speaker. In such a case the sound may be "thickened" as described above to improve the listening experience. Additionally or alternatively DRC may be determined or optimized based on the estimated location of a person.

In another approach, which may be combined with one or more of the foregoing, the sound category/anomalous sound recognition and estimated location may be used to infer information about the environment in which the device/speaker is operating, and this in turn may then be used to steer the reproduced (played) sound to improve the user experience.

Thus the sound to be reproduced by the speaker is typically derived from a play audio data stream. This data stream may comprise data representing a plurality of audio channels each providing a different representation of one or more sources of sound represented by the data stream. The data stream may be provided to the device already comprising multiple channels, for example where the channels comprise surround or other channels of a surround sound data stream. Additionally or alternatively the data stream may be processed to generate a plurality of different channels—techniques for doing this are known, for example in the field of surround sound and in other contexts.

Thus in embodiments multiple channels are available in which different channels relate to different representations, sources, or combinations of sources of the original audio. For example one channel might relate mainly to a soloist and another to the accompanying musicians; alternatively channels may relate to different audio frequency bands such as high, and/or mid, and/or low frequency bands. The method/system may then steer the different channels differently based on the location of the recognized sound category/sound. For example one channel may be steered in a directional manner, so that it creates a "thin" sound. Another channel may be steered in multiple different directions, for example with the expectation that the sound will bounce off walls and other surfaces, in order to create a "thick" sound. A channel may be steered physically or perceptually, as previously described, for example using a HRTF.

Similarly a first channel may be steered in a first direction and a second channel in a second, different direction. Directions for the channels may be selected based upon the recognized category of sound and/or an estimated location of a recognized sound. For example a soloist may be directed towards an estimated sound location, where the location is one where one or more persons are expected to be, whilst accompaniment may be directed in multiple directions to thicken this channel. Or if, say, a cooking sound is detected a first, e.g. accompaniment channel may be directed in multiple directions to thicken this channel whilst a second, e.g. soloist channel may be generally directed in a single direction; optionally this and other steering may be done without estimating a location of the recognized sound category. In broad terms, different channels may be directed differently depending upon a recognized sound category in the background, for example to thicken and/or thin the channels.

In another aspect there is provided a method/system for controlling sound generation by a device including a loudspeaker. The method/system may comprise capturing audio from an environment local to the device, and inputting a play audio data stream representing audio to be played by the device. The play audio data stream may be received by the device over a wired or wireless data link and/or may be retrieved from a local or remote memory. Sound is reproduced according to the play audio modified by a speaker response, which may be a response of the loudspeaker or of a speaker and speaker driver combination, or more preferably, of the device including the loudspeaker. The speaker response may define how the device/speaker reproduces audio and may comprise a frequency response and/or time response of the device/speaker. The method/system may then process the captured audio to recognize one or more categories of sound, thus determining properties of environment into which the speaker is to project the sound. Then the method/system may adjust the speaker response dependent upon a recognized sound (category) and/or analysis of the sound (category). The analysis may be as previously described.

The adjusting may, for example, comprise adjusting a dynamic compression response of the device/speaker. For example, if a "party" sound category is recognized then because the noise floor is expected to be raised the dynamic compression response can be adjusted to raise or limit a low end of the response (relatively increase the gain at low input levels). Additionally or alternatively in the same situation the upper end of the dynamic compression response may be adjusted to lower or limit the response (relatively decrease the gain at high input levels), to avoid people having to shout to be heard. In general the dynamic compression response may be defined by a curve (which here includes a straight line and a piecewise linear function) relating input level in dB to output level in dB. The shape of this curve may be adjusted in response to recognizing a sound/sound category.

Optionally the method/system may determine one or more characteristics of audio represented by the play audio data stream. For example a set of measurements may be made on the audio to be reproduced to determine one or more volume metrics of the sound, optionally by frequency band; and/or maximum and/or minimum volume, a maximum estimated SPL (sound pressure level) of the speaker output, and so forth. These data may be combined with the recognized sound category to adjust the speaker response, for example to increase the gain where the audio is characterized as having a low level and where the background sound is expected to have a higher level; and/or vice-versa.

In another approach, which may be combined with adjusting a dynamic compression response of the device/speaker, the method/system may determine a perceptual masking of the play audio data stream by the (recognized) captured audio. The perceptual masking may be determined by determining one or more masking thresholds which define how the reproduced audio and background (recognized) audio interact perceptually. The perceptual masking may comprise one or both of frequency masking, when one sound masks another nearby in frequency when the second sound is below a masking threshold; and temporal masking, when one sound masks another nearby in time when the second sound is below a masking threshold. Such techniques are employed in MP3 files so as to omit parts of a sound signal which may not be perceived. In the present case recognizing a category of sound may be employed to select a masking model, for example comprising a set of masking thresholds, which may then be applied to the "play" audio to be reproduced.

Processing the play based on a recognition of the audio environment the speaker is projecting into can also help to separate the perceived audio, especially if this is combined with adjusting the dynamic compression response as previously described.

Such an approach can also help to reduce power consumption, particularly of a battery powered device, because the speaker is not being driven to produce sounds which will not generally be perceived. This will tend to reduce the power dissipation of both the speaker driver (amplifier) and loudspeaker.

Thus in another aspect there is provided a method/system for controlling sound generation by a device including a loudspeaker, the method comprising: capturing audio from an environment local to the device; inputting a play audio data stream representing audio to be played by the device; and adjusting the audio played by the device dependent upon predicted perceptual masking by the audio from the environment.

Typically a speaker will have different efficiencies at different frequencies, that is the SPL per electrical watt will vary with frequency of reproduced sound. Optionally the frequency response of electrical-to-sound speaker efficiency can be taken into account when adjusting the speaker response/dynamic compression response and/or when selecting one or more perceptual masking thresholds as described in the various aspects above. For example the method/system may take into account the requirement for less electrical energy for a particular (perceptual) audible output level at some frequencies than at others.

In a related aspect there is provided a method/system for controlling the power consumption, in particular of a battery-powered device having a speaker, such as a portable speaker, smart speaker, or mobile device such as a mobile phone, tablet or laptop. The method may comprise limiting the power consumption of a speaker driver and/or loudspeaker of the device by suppressing reproduction of sounds or sound elements (i.e. parts of the time-frequency spectrum) at frequencies and/or times dependent upon one or more masking thresholds defined by environmental audio, more particularly when their reproduction is masked by other audio in the environment local to the device.

The method/system may also include one or more of: capturing audio from an environment local to the device; inputting an audio data stream representing audio to be played by the device; determining one or more perceptual masking thresholds from the captured environmental audio (optionally taking into account speaker efficiency as described above); filtering, typically digitally, the audio data stream to suppress sounds at frequencies and/or times predicted to be masked; and outputting a version of the filtered audio from the speaker.

The skilled person will appreciate that the various aspects of the methods/systems described above may readily be combined with one another, in many cases synergistically because the sound category recognition may be common to the methods/systems when two or more are combined.

There is further provided processor control code to implement the above-described methods and systems, for example on a general purpose computer system or on a digital signal processor (DSP). The processor control code, when running, may implement any of the above methods; the code may be provided on a non-transitory data carrier such as a disk, microprocessor, CD- or DVD-ROM, programmed memory such as non-volatile memory (e.g. Flash) or read-only memory (Firmware). Code and/or data to implement embodiments of the invention may comprise source, object or executable code in a conventional programming language (interpreted or compiled) such as C, or assembly code, code for setting up or controlling an ASIC (Application Specific Integrated Circuit) or FPGA (Field Programmable Gate Array), or code for a hardware description language such as Verilog™ or VHDL (Very high speed integrated circuit Hardware Description Language). As the skilled person will appreciate such code and/or data may be distributed between a plurality of coupled components in communication with one another.

Typically, but not essentially, the methods and systems described above are implemented in the digital domain.

Thus there is also provided an electronic device or system comprising: an input to receive play audio data for reproduction; one or more loudspeakers to reproduce the play audio data; one or more microphones to capture audio from the local environment; a processor, coupled to the input, microphone and loudspeaker, to working memory, and to program memory storing processor control code comprises code to implement a method as described above. Typically the device will include an analogue-to-digital converter for the microphone(s) and a digital-to-analogue converter for the loudspeaker(s). The sound (category) recognition need not take place on the device—conveniently a digital representation of sound to be recognized may be sent to a server in the cloud and corresponding sound recognition data returned, defining one or more categories of recognizes sound(s). Thus preferred embodiments of the device will typically include a network connection such as a WiFi connection and/or interface to a mobile communications network. More generally, the functionality of such a device may be split over a set of modules in communication with one another.

The device may be a portable speaker or smart speaker, a mobile device such as a mobile phones, tablet, or laptop, a portable music player, an e-readers, a personal computer, a sound bars, a television, or any other electronic device configured to reproduce audio.

The techniques we describe can be implemented on

BRIEF DESCRIPTION OF THE DRAWINGS

These and other aspects of the methods and systems will now be further described, by way of example, with reference to the accompanying drawings, in which.

DETAILED DESCRIPTION OF PREFERRED EMBODIMENTS

Figure 1A:
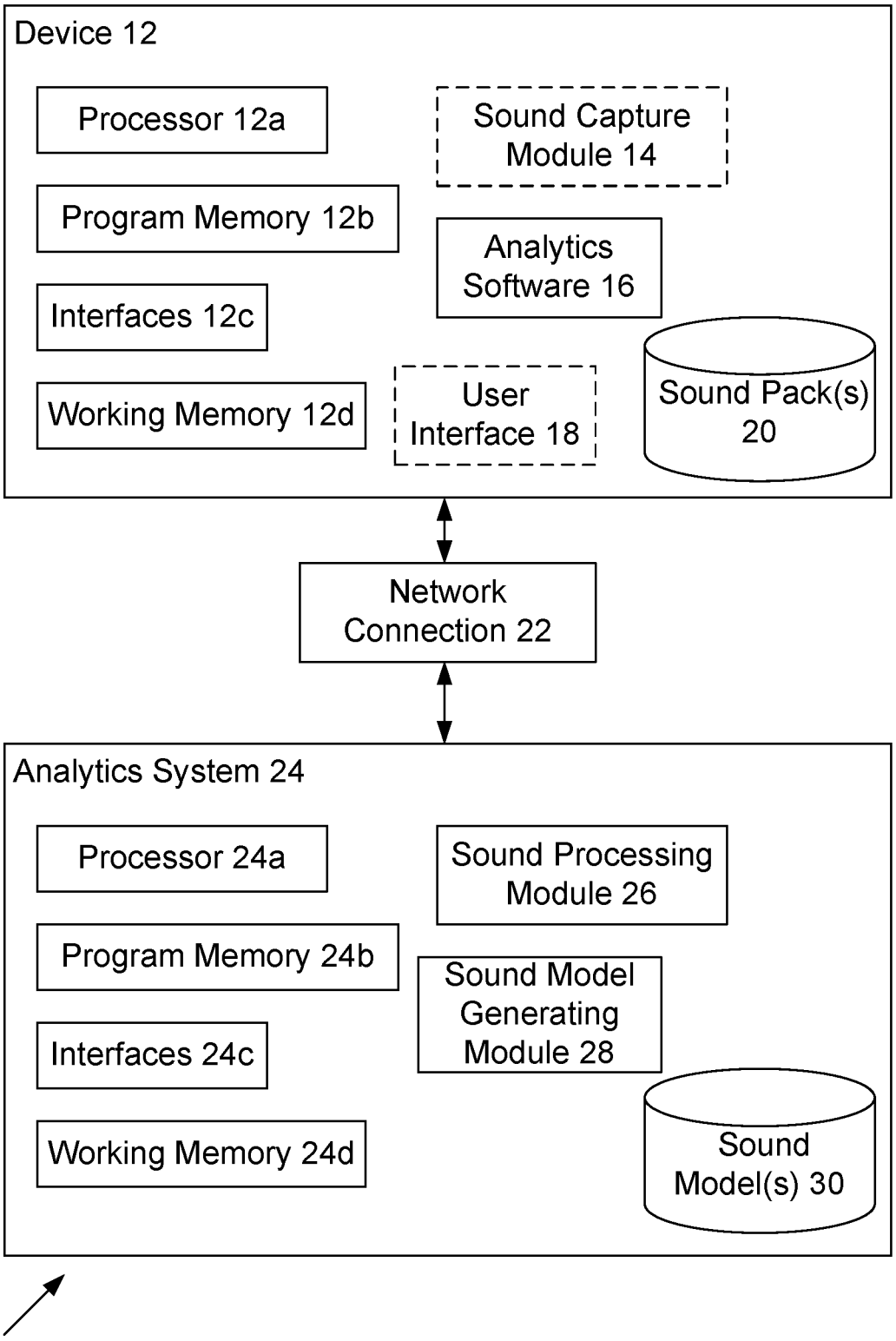
FIG. 1*a* shows a block diagram of a general system to generate sound models and identify detected sounds.

To date sound recognition has largely been used for safety and security wellness and wellbeing. Given the growth in smart speakers (speakers which include person assistants typically costing $100-$300) as well as the increase in quality of the sound reproduction has led to market research firms like Gartner to predict that 75% of US will have a smart speaker by 2020 some 100 million units currently the units sold are about 7%.

There are many key functions of a smart speaker including safety, security, wellness and wellbeing.

Additional functions include entertainment and information request. There may be a range of impacts that can be made on the music reproduction quality based on an understanding of what sound environment is present in the room or location of the smart speaker.

As examples, we describe 4 areas of smart speaker audio/music playback that a sound recognition system can improve:

1) Using sound detection to improve automatic room correction algorithms or automatic digital room correction (DRC) algorithms;
2) Using sound detection to improve steering of sound for devices with speaker arrays;
3) Using sound detection to improve listening experience through intelligent filtering; and
4) Using sound detection to improve battery life through intelligent filtering to improve speaker efficiency.

1) Using Sound Detection to Improve Automatic Room Correction Algorithms or Automatic Digital Room Correction (DRC) Algorithms.

One goal of a smart speaker is to have a single speaker in the corner of the room and have it fill that room with sound. If the audio environment in which the sound is happening is understood then the listening experience can be improved.

For example, if the audio context is in force and is accurate, modifications could be made DRC to improve the listener experience.

The audio context detection could be used to choose a number of options based on its understanding of the sound environment.

Examples of problems that DRC looks to address are:

a. Room Resonances/Standing Waves
b. Misalignment of Drivers
c. Early Reflections/Cabinet Diffraction
d. Late Reflections/Room Reverberation DRC is often optimised to achieve the sound coming out of the speaker being consistent, for example, not coloured by the room across these attributes. A problem to be solved is how does sound in the room interfere with DRC calculations.

Some different techniques of performing DRC are now described.

a) One technique involves taking a set of measurements around the room to determine room response, with an extra focus on determining the room response around a listener. The room response measurements may be made using a mobile phone with an application to take the measurements. One problem with this technique is that the user has to actively take the measurements, moving around the room. Furthermore, this may have to be done in advance of when the DRC capabilities are needed, causing inconvenience for the user.
b) Another technique of performing DRC is for the speaker to comprise one or more microphones. The speaker produces a sound, or a series of sounds, that are specifically used during the DRC process. The speaker records the response of the emitted sounds. The speaker can then perform some DRC calculations using the room response of the emitted sounds. This has the drawback of requiring a quiet room when determining the room response, in order for the DRC calculations to be accurately performed, because the DRC calculations rely on the response of a known sound or sounds.
c) Another technique is for the smart speaker (comprising one or more microphones) to detect sound in the room. For example, there could be speech occurring in the room. The speaker can detect the sound in the room and through sound recognition techniques (herein described or other), detect that the sound is speech. After the sound has been recognised as speech the speaker can perform various processes on the captured speech.

The speaker could use machine learning techniques to develop a connection between the detected speech and the room response. Due to the room response, the speech will be altered or "warped" compared to speech detected with no (or a flat) room response. The outcome of the machine learning connection could be an extracted room response. The extracted room response can be compared to a set number of preset room responses and the closest match could be found. The speaker can then apply DRC corrections appropriate to the preset room response that was closest to the machine learnt room response.

Alternatively the speaker can record or detect the "warped" speech, and reconstruct a sound (in this example, a speech) profile corresponding to a flat or known, room response. This would comprise utilising known parameters which generally characterise speech. Due to sound recognition techniques, parameters that correspond to generic speech are used to reconstruct the "warped" speech to resemble what is considered a more generic or general speech sound profile.

In both of these methods, the smart speaker can determine a recorded/detected sound environment. Once the speaker has calculated the room response it can apply the DRC calculations to all emitted sounds.

2) Using Sound Detection to Improve Steering of Sound for Devices with Speaker Arrays.

Information received by understanding the audio environment information can be used to better direct which and what signals to play out of one or a number of the speakers in the array to improve listening experience.

Some smart speakers will have an array of speakers, more specifically, commonly an array of tweeter speakers. Having more than one speaker gives the smart speaker the ability to steer or direct sound. Due to the higher frequency of sound emitted from a tweeter speaker compared to, for example, a sub-woofer, the sound emitted from a tweeter can receive a large benefit, in regards to listenability, from steering.

An aim of sound steering is to create a sound that appears to a listener to be a stereo sound emitted from a single device.

One example of how steering sound can be used concerns the "thickening" or "thinning" of the emitted sound as appropriate.

A thin sound is generally considered to be a very directional sound, relying on little or no reflection off of nearby surfaces. An example may be of a conversation between two people in an outside environment. The sound is very directional. Thin sound is generally considered to have high intelligibility but also considered to not be very pleasing to a listener because it can suffer from a lack of texture or richness.

Conversely, thick sound is considered give a listener a more pleasurable listening experience, and sounds richer. Thick sound is generally regarded as sound that bounces off walls, giving the impression that the room is filled with sound. However, too much reflection off of walls can reduce the perceived sound quality.

In embodiments, the smart speaker can detect the presence and location of a listener in the room. The smart speaker can constantly monitor the ambient noise, and use an anomaly detection process to detect anomalies in the vicinity of the smart speaker. Sound anomalies can correlate to human activity, and hence a potential listener. Therefore, in embodiments, detecting sound anomalies is a proxy for detecting human listeners. Anomaly detection could be deployed by analysing sound energy metrics in the sound. The sound measurements may be long running measurements. Machine learning based methods may also be used in embodiments.

Once the smart speaker has detected an anomaly it can then determine the direction or location of the listener or listeners. This can be done via triangulation of the sounds detected by the array of microphones. The location may be where the room is divided up into quadrants or other sections. The location may be an exact location. In embodiments, sound environment recognition may be used to further determine what the anomaly is. This step may be incorporated in the anomaly detection process.

Once the location of the anomaly has been detected, the smart speaker can perform the appropriate sound steering processes. In embodiments, this may be to direct part or all of the music towards the listener. In embodiments, the appropriate sound steering process may be to reflect the sound against the walls of the room.

In embodiments, the smart speaker may detect that there is sound that corresponds to the sound environment of someone cooking. The smart speaker may also detect the location of the person cooking and perform an appropriate sound steering operation. For example, if the song playing is a jazz track, with a lead trumpet and a backing band comprising drums, bass and piano, the smart speaker may direct the lead trumpet line towards the speaker, providing clarity, whilst simultaneously emitting the backing track as a thick sound by reflecting the backing track off of the walls of the room, giving the listener a sense of a rich, pleasing sound. This example may utilise the mixing of the song into separate channels.

In embodiments, the smart speaker may process or steer each channel in a separate way. This may involve extracting different channels out of the audio file is the audio file was not mixed with different channels.

3) Using Sound Detection to Improve Listening Experience Through Intelligent Filtering By detecting the audio environment, the play back of audio can be better filtered to improve the listening experience. In general, the sound environment is needed to be known in order to optimise the output of the smart speaker. If the sound environment cannot be determined in real time, then the smart speaker would have to rely on a number of preset settings. Therefore it is an advantage to be able to determine the sound environment of a smart speaker in conjunction with filtering processes.

Different mapping between sound properties (for example, frequency and loudness) are needed for different ambient contexts. There are generally three areas where noise (not music) in the environment could be impactful:

1. Audible noise in a frequency range where very little or nothing is spectrally present in the music/sound signal;
2. Audible noise in a frequency range where the music/sound signal is spectrally present and audible; and
3. Audible noise in a frequency range where the music/sound signal is spectrally present but no longer audible, due to masking.

In case 1, very little can be done to hide the noise, besides raising the overall sound level. In worst case, this may not even be able to mask the noise, if the music is spectrally far from the noise, as the effect of masking is more profound the closer the two notes are.

In case 2, the altered equal loudness contour could be taken into account, and a more tonally "correct" music presentation is possible using either equalization or compression and gain.

In case 3 it is not feasible to focus on loudness contours, instead the main focus should be to make the inaudible frequency areas at the very least audible.

In an example, there may be noise in the background. Dynamic audio compression can be used to fill the space in the dynamic range. This comprises taking metrics, for example volume, and also comprises the smart speaker having access to the capabilities of sound output of the smart speakers. It may utilise downward compression or upward compression.

In embodiments, other compression techniques can be used. Knowledge of the masking threshold can be used. The masking threshold relates to how two sounds of a similar frequency interact with one another. Specifically, the masking threshold is the sound pressure level, in dB for example, of a sound at a certain frequency needed to make the sound audible whilst a second sound (at a different frequency) is present. A loud sound at a given frequency can "mask" less loud sounds of frequencies either side of the loud sound. Masking can also be temporal rather than purely relating to frequency.

In embodiments, a Head Related Transfer Function (HRTF) can be implemented. In general, a HRTF is a filter that characterises the sound of a person's ears and can improve stereo imaging. HRTF is generally based taking into account how sound travels through the head of a listener and how sound travelling through the head is affected before reaching the ear. The sound received by the ear closest to the sound will be different to sound received at the ear on the far side of the head because the sound has to have travelled through the head to reach the ear on the far side. By utilising a HRTF, the listener can perceive the sound to be a richer sound that is more pleasurable to listen to. HRTF when applied to a sound emitted from a single speaker can create the perception of a stereo sound.

Detecting the sound environment can be used to apply HRTF in effective way. For example, if it is detected that the sound environment is a party, with lots of people present, then the smart speaker may determine that steering the sound towards the walls, to give a richer and thicker sound, may not be appropriate because of the mass of people present. In this scenario, HRTF may be a more appropriate response. Therefore, by determining the sound environment, the smart speaker can apply a suitable filtering function to the sound to create a better listening experience.

4) Using Sound Detection to Improve Battery Life Through Intelligent Filtering to Improve Speaker Efficiency Information gathered by understanding the audio environment can be used to better optimise speaker efficiency and hence improve battery powered smart speakers, phones or tablets by giving them a better optimised battery performance.

For smart speakers that rely on battery power, battery life is a key attribute. A longer lasting battery life is especially important for portable smart speakers.

In embodiments, if it can be determined that there are certain audio characteristics in the audio environment then it is possible to determine if it is worth pursuing a tactic of increasing the audio level of the speaker. Increasing the audio level would require more power which might have a meaningful impact on the battery life.

One aspect in determining a speaker's battery life is the speaker efficiency, also known as speaker sensitivity. Speaker efficiency is a measure of the speaker's output, often measured in decibels, with a specified amount of amplifier power (often measured in Watts). For example, speaker efficiency is often measured with a microphone (connected to a sound level meter) placed one meter from the speaker. One watt of power is delivered to the speaker and the level meter measures the volume in decibels. The output level results in a measure of efficiency. Speakers have different speaker efficiencies at different frequencies, meaning that some speakers may be more energy efficient at producing a sound of 100 Hz than another speaker but less energy efficient at producing a sound of 500 HZ compared to the other speaker.

In embodiments, the smart speaker can determine the sound environment and determine if the speaker has the capability to overcome the frequency threshold (optionally including masking effects) of a given background sound. If the speaker determines that it is unable to produce a sound that can overcome the background sound at a given frequency then it will stop producing that sound. This means that the battery life will last longer because the speaker is producing less sound but in a way that is unnoticeable (or almost unnoticeable) to a listener.

Knowledge of the speaker efficiency can also be taken into account when considering the frequency threshold. For example, if the smart speaker has information regarding the speaker efficiency at all different frequencies then it can be programmed to take into consideration how energy efficient a given frequency is when determining whether or not to continue to produce a sound that is near a frequency threshold.

It is understood that the methods described can be performed not only by a smart speaker but also by devices such as phones, tablets, sound bars and other suitable devices. It is also understood that any of the methods and techniques described above may be used simultaneously or separately by a device.

Example of Audio Tuning for a Party

The following is by way of example only.

If there was party or noisier gathering detected then audio processing could be added to improve the quality of the music, some examples of the audio processing include:

- Dynamic range compression, to increase the overall loudness of the music;
- Filtering to increase bass and high frequencies, leaving the mid-frequencies less amplified, this can increase the perceived loudness; and
- Apply a HRTF to the upper frequencies to widen the stereo image for all listeners On a multi-driver array it is also possible to provide the listeners with a more 'omnidirectional' sound field which may give each listener a better image of the music. This can be carried out by processing the audio using wavefield synthesis techniques.

1) Example of Audio Tuning for Passive Listening Detection

The following is by way of example only.

In a passive listening scenario a user will want the device (for example, the device could be a smart speaker) to playback audio in a way that allows them to hear music effectively although it is not the centre of attention. The following processing are some examples of what could be effective at providing that experience:

- Small reduction in dynamic range so quiet sounds are not lost to background noise; and
- Use a neutral filter profile so the audio is less tiring to the ears.

A multi-driver array in this scenario could be used to direct the sound towards the listener 2) Example of Audio Tuning for Active Listening The following is by way of example only.

In an active listening mode the user may want the best quality accurate environment. The dynamic range would be left unprocessed and audio filtering could be made to bring out details in recordings.

On a device with a driver array spatial enhancements could be used to provide the best imaging, and also may make sure the audio is directed towards the listener.

3) Example of Environmental Adaptation

The following is by way of example only.

In embodiments, even with a single microphone the device would be able to adjust its tuning to best fit the environment using the recorded proximity effect as a guide. The DSP would then be able to apply some EQ to control the bass if there was a detection of it being in a less than ideal position.

With a microphone array the device would be able to more accurately work out what position it were in, whether it had any enclosed sides and the direction of room acoustic noise could be calculated. This information would allow the speaker to process audio with some more accurate filtering.

If the device had a driver array the audio could be beam formed to direct the audio out to the room.

Implementation

By way of guidance to the skilled person regarding incorporation of the techniques into electronic devices, FIGS. 1-6 show examples of a system which may be adapted to provide implementations of the techniques described in the summary section and thereafter. Thus elements of the systems illustrated may be omitted where unnecessary for a particular implementation, and additional processing as previously described may be included.

1. Sound Capture and Identification

FIG. 1*a* shows a block diagram of a general system 10 to generate sound models and identify detected sounds. A device 12 is used to capture a sound, store a sound model associated with the captured sound, and use the stored sound model to identify detected sounds. The device 12 can be used to capture more than one sound and to store the sound models associated with each captured sound. The device 12 may be a PC, a mobile computing device such as a laptop, smartphone, tablet-PC, a consumer electronics device (e.g. a webcam, a smart microphone, etc.) or other electronics device (e.g. a security camera). The device comprises a processor 12*a* coupled to program memory 12*b* storing computer program code to implement the sound capture and sound identification, to working memory 12*d* and to interfaces 12*c* such as a screen, one or more buttons, keyboard, mouse, touchscreen, and network interface.

The processor 12*a* may be an ARM® device. The program memory 12*b* stores processor control code to implement functions, including an operating system, various types of wireless and wired interface, storage and import and export from the device.

In particular the device 12 comprises a user interface 18 to enable the user to, for example, associate an action with a particular sound. The user interface 18 may, alternatively, be provided via a second device (not shown), as explained in more detail with respect to FIG. 5 below. A wireless interface, for example a Bluetooth®, Wi-Fi or near field communication (NFC) interface is provided for interfacing with other devices and the analytics system 24.

The device 12 may comprise a sound capture module 14, such as a microphone and associated software. In other arrangements, the sound capture module 14 may be provided via a separate device (not shown), such that the function of capturing sounds is performed by a separate device. This is described in more detail with reference to FIG. 1*a* below.

The device 12 comprises a data store 20 storing one or more sound models (or "sound packs"). In example implementations, the sound model for each captured sound is generated in a remote sound analytics system 24, such that a captured sound is sent to the remote analytics system for processing, and the remote analytics system returns a sound model to the device. The device 12 may be configured to store user-defined or user-selected actions which are to be taken in response to the identification of a particular sound. This has an advantage that the device 12 which captures and identifies sounds does not require the processing power or any specific software to analyse sounds and generate sound models.

Another advantage is that the device 12 stores the sound models locally (in data store 20) and so does not need to be in constant communication with the remote system 24 in order to identify a captured sound.

Thus, the sound models are obtained from the analytics system 24 and stored within the device 12 (specifically within data store 20) to enable sounds to be identified using the device, without requiring the device to be connected to the analytics system. The device 12 also comprises analytics software 16 which is used to identify a detected sound, by comparing the detected sound to the sound models (or "sound packs") stored in the data store 20. In the example implementation of FIG. 1*a*, the analytics software is not configured to generate sound models for captured sounds, but merely to identify sounds using the stored sound models. The device 12 comprises a networking interface to enable communication with the analytics system 24 via the appropriate network connection 22 (e.g. the Internet). Captured sounds, for which sound models are to be generated, are sent to the analytics system 24 via the network connection 22.

In FIG. 1*a*, the analytics system 24 is located remote to the device 12. The analytics system 24 may be provided in a remote server, or a network of remote servers hosted on the Internet (e.g. in the Internet cloud), or in a device/system provided remote to device 12. For example, device 12 may be a computing device in a home or office environment, and the analytics system 24 may be provided within a separate device within the same environment. The analytics system 24 comprises at least one processor 24*a* coupled to program memory 24*b* storing computer program code to implement the sound model generation method, to working memory 24*d* and to interfaces 24*c* such as a network interface. The analytics system 24 comprises a sound processing module 26 configured to analyse and process captured sounds received from the device 12, and a sound model generating module 28 configured to create a sound model (or "sound pack") for a sound analysed by the sound processing module 26. In example implementations, the sound processing module 26 and sound model generating module 28 are provided as a single module.

The analytics system 24 further comprises a data store 30 containing sound models generated for sounds received from one or more devices 12 coupled to the analytics system 24. The stored sound models may be used by the analytics system 24 (i.e. the sound processing module 26) as training for other sound models, to perform quality control of the process to provide sound models, etc.

Figure 1B:
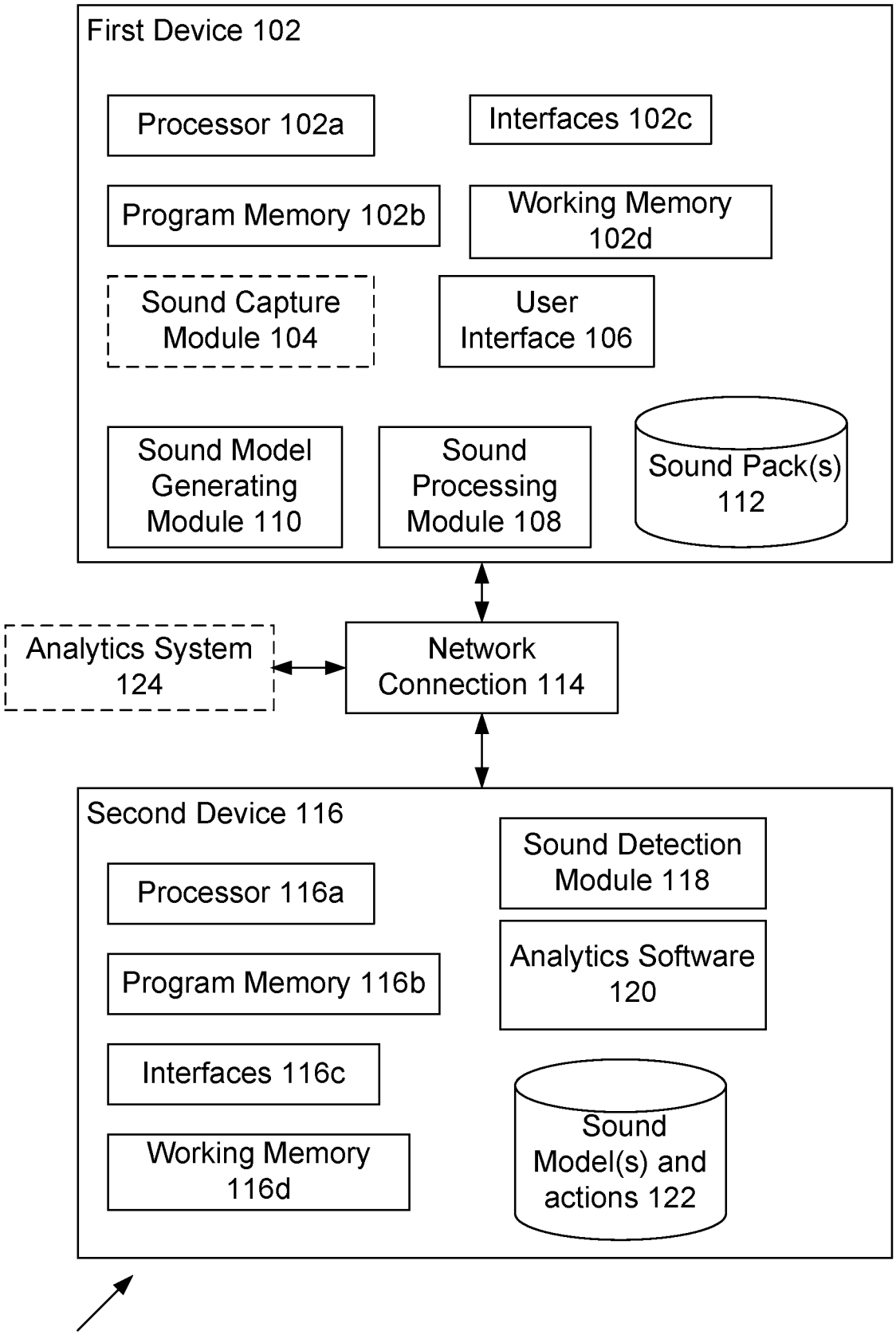
FIG. 1*b* shows a block diagram of a general system to generate sound models and identify detected sounds.

FIG. 1*b* shows a block diagram of a general system 100 to generate sound models and identify detected sounds in a further example implementation. In this example implementation, a first device 102 is used to capture a sound, generate a sound model for the captured sound, and store the sound model associated with the captured sound. The sound models generated locally by the first device 102 are provided to a second device 116, which is used to identify detected sounds. The first device 102 of FIG. 1*b* therefore has the processing power required to perform the sound analysis and sound model generation itself, in contrast with the device of FIG. 1*a*, and thus a remote analytics system is not required to perform sound model generation.

The first device 102 can be used to capture more than one sound and to store the sound models associated with each captured sound. The first device 102 may be a PC, a mobile computing device such as a laptop, smartphone, tablet-PC, a consumer electronics device (e.g. a webcam, a smart microphone, a smart home automation panel etc.) or other electronics device. The first device comprises a processor 102*a* coupled to program memory 102*b* storing computer program code to implement the sound capture and sound model generation, to working memory 102*d* and to interfaces 102*c* such as a screen, one or more buttons, keyboard, mouse, touchscreen, and network interface.

The processor 102*a* may be an ARM® device. The program memory 102*b* stores processor control code to implement functions, including an operating system, various types of wireless and wired interface, storage and import and export from the device.

The first device 102 comprises a user interface 106 to enable the user to, for example, associate an action with a particular sound. The user interface may be display screen, which requires a user to interact with it via an intermediate device such as a mouse or touchpad, or may be a touchscreen. A wireless interface, for example a Bluetooth®, Wi-Fi or near field communication (NFC) interface is provided for interfacing with the second device 116 and optionally, with a remote analytics system 124. In example implementations, although the first device 102 has the capability to analyse sounds and generate sound models itself, the first device 102 may still communicate with a remote analytics system 124. For example, the first device 102 may provide the captured sounds and/or the locally-generated sound models to the remote analytics system 124 for quality control purposes or to perform further analysis on the captured sounds. Advantageously, the analysis performed by the remote system 124, based on the captured sounds and/or sound models generated by each device coupled to the remote system 124, may be used to update the software and analytics used by the first device 102 to generate sound models. The analytics system 124 may therefore comprise at least one processor, program memory storing computer program code to analyse captured sounds, working memory, interfaces such as a network interface, and a data store containing sound models received from one or more devices coupled to the analytics system 124.

The first device 102 may, example implementations, comprise a sound capture module 104, such as a microphone and associated software. In other example implementations the sound capture module 104 may be provided via a separate device (not shown), such that the function of capturing sounds is performed by a separate device. In either case, the first device 102 receives a sound for analysis.

The first device 102 comprises a sound processing module 108 configured to analyse and process captured sounds, and a sound model generating module 110 configured to create a sound model (or "sound pack") for a sound analysed by the sound processing module 108. In example implementations, the sound processing module 108 and sound model generating module 110 are provided as a single module. The first device 102 further comprises a data store 112 storing one or more sound models (or "sound packs"). The first device 102 may be configured to store user-defined or user-selected actions which are to be taken in response to the identification of a particular sound. The user interface 106 is used to input user-selected actions into the first device 102.

The sound models generated by the sound model generating module 110 of device 102 are provided to the second device 116 to enable the second device to identify detected sounds. The second device 116 may be a PC, a mobile computing device such as a laptop, smartphone, tablet-PC, a consumer electronics device or other electronics device. In a particular example implementations, the first device 102 may be a smart panel (e.g. a home automation system/device) or computing device located within a home or office, and the second device 116 may be an electronics device located elsewhere in the home or office. For example, the second device 116 may be a security system.

The second device 116 receives sound packs from the first device 102 and stores them locally within a data store 122. The second device comprises a processor 116*a* coupled to program memory 116*b* storing computer program code to implement the sound capture and sound identification, to working memory 116*d* and to interfaces 116*c* such as a screen, one or more buttons, keyboard, mouse, touchscreen, and network interface. The second device 116 comprises a sound detection module 118 which is used to detect sounds. Analytics software 120 stored on the second device 116 is configured to analyse the sounds detected by the detection module 118 by comparing the detected sounds to the stored sound model(s). The data store 122 may also comprise user-defined actions for each sound model. In the example implementation where the second device 116 is a security system (comprising at least a security camera), the second device 116 may detect a sound, identify it as the sound of breaking glass (by comparing the detected sound to a sound model of breaking glass) and in response, perform the user-defined action to swivel a security camera in the direction of the detected sound.

The processor 116*a* may be an ARM® device. The program memory 116*b*, in example implementations, stores processor control code to implement functions, including an operating system, various types of wireless and wired interface, storage and import and export from the device. The second device 116 comprises a wireless interface, for example a Bluetooth®, Wi-Fi or near field communication (NFC) interface, for interfacing with the first device 102 via network connection 114.

An advantage of the example implementation of FIG. 1*b* is that the second device 116 stores the sound models locally (in data store 122) and so does not need to be in constant communication with a remote system 124 or the first device 102 in order to identify a detected sound.

Figure 1C:
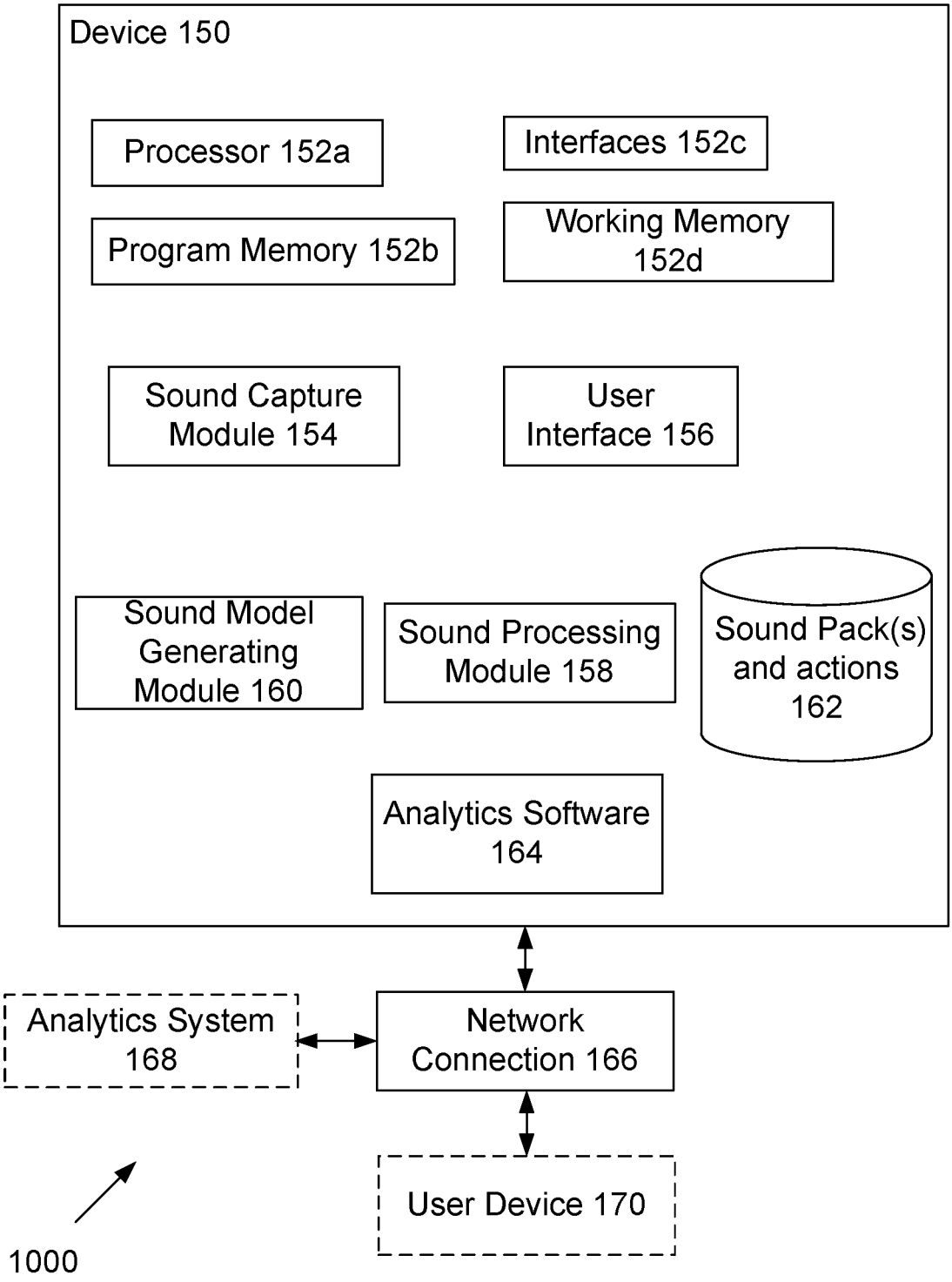
FIG. 1*c* shows a block diagram of a general system to generate sound models and identify detected sounds.

FIG. 1*c* shows a block diagram of a general system 1000 to generate sound models and identify detected sounds in a further example implementation. In this example implementation, a device 150 is used to capture a sound, generate a sound model for the captured sound, store the sound model associated with the captured sound, and identify detected sounds. The sound models generated locally by the device 150 are used by the same device to identify detected sounds. The device 150 of FIG. 1*c* therefore has the processing power required to perform the sound analysis and sound model generation itself, in contrast with the device of FIG. 1*a*, and thus a remote analytics system is not required to perform sound model generation. A specific example of this general system 1000 is described below in more detail with reference to FIG. 5.

In FIG. 1*c*, the device 150 can be used to capture more than one sound and to store the sound models associated with each captured sound. The device 150 may be a PC, a mobile computing device such as a laptop, smartphone, tablet-PC, a consumer electronics device (e.g. a webcam, a smart microphone, a smart home automation panel etc.) or other electronics device. The device comprises a processor 152*a* coupled to program memory 152*b* storing computer program code to implement the methods to capture sound, generate sound models and identify detected sounds, to working memory 152*d* and to interfaces 152*c* such as a screen, one or more buttons, keyboard, mouse, touchscreen, and network interface.

The processor 152*a* may be an ARM® device. The program memory 152*b* stores processor control code to implement functions, including an operating system, various types of wireless and wired interface, storage and import and export from the device.

The first device 150 comprises a user interface 156 to enable the user to, for example, associate an action with a particular sound. The user interface may be display screen, which requires a user to interact with it via an intermediate device such as a mouse or touchpad, or may be a touchscreen. A wireless interface, for example a Bluetooth®, Wi-Fi or near field communication (NFC) interface is provided for interfacing with a user device 170 and optionally, with a remote analytics system 168. In example implementations, although the device 150 has the capability to analyse sounds, generate sound models itself and identify detected sounds, the device 150 may also be coupled to a remote analytics system 168. For example, the device 150 may provide the captured sounds and/or the locally-generated sound models to the remote analytics system 168 for quality control purposes or to perform further analysis on the captured sounds. Advantageously, the analysis performed by the remote system 168, based on the captured sounds and/or sound models generated by each device coupled to the remote system 1268, may be used to update the software and analytics used by the device 150 to generate sound models. The device 150 may be able to communicate with a user device 170 to, for example, alert a user to a detected sound. A user of device 150 may specify, for example, that the action to be taken in response to a smoke alarm being detected by device 150 is to send a message to user device 170 (e.g. an SMS message or email). This is described in more detail with reference to FIG. 5 below.

The device 150 may, in example implementations, comprise a sound capture module 154, such as a microphone and associated software. In other example implementations, the sound capture module 154 may be provided via a separate device (not shown) coupled to the device 150, such that the function of capturing sounds is performed by a separate device. In either case, the device 150 receives a sound for analysis. The device 150 comprises a sound processing module 158 configured to analyse and process captured sounds, and a sound model generating module 160 configured to create a sound model (or "sound pack") for a sound analysed by the sound processing module 158. In example implementations, the sound processing module 158 and sound model generating module 160 are provided as a single module. The device 150 further comprises a data store 162 storing one or more sound models (or "sound packs"). The device 150 may be configured to store user-defined or user-selected actions which are to be taken in response to the identification of a particular sound in data store 162. The user interface 156 is used to input user-selected actions into the device 150.

The sound models generated by the sound model generating module 160 are used by device 150 to identify detected sounds. An advantage of the example implementation of FIG. 1*c* is that a single device 150 stores the sound models locally (in data store 162) and so does not need to be in constant communication with a remote system 168 in order to identify a detected sound.

2. Sound Model Generation

Figure 2A:
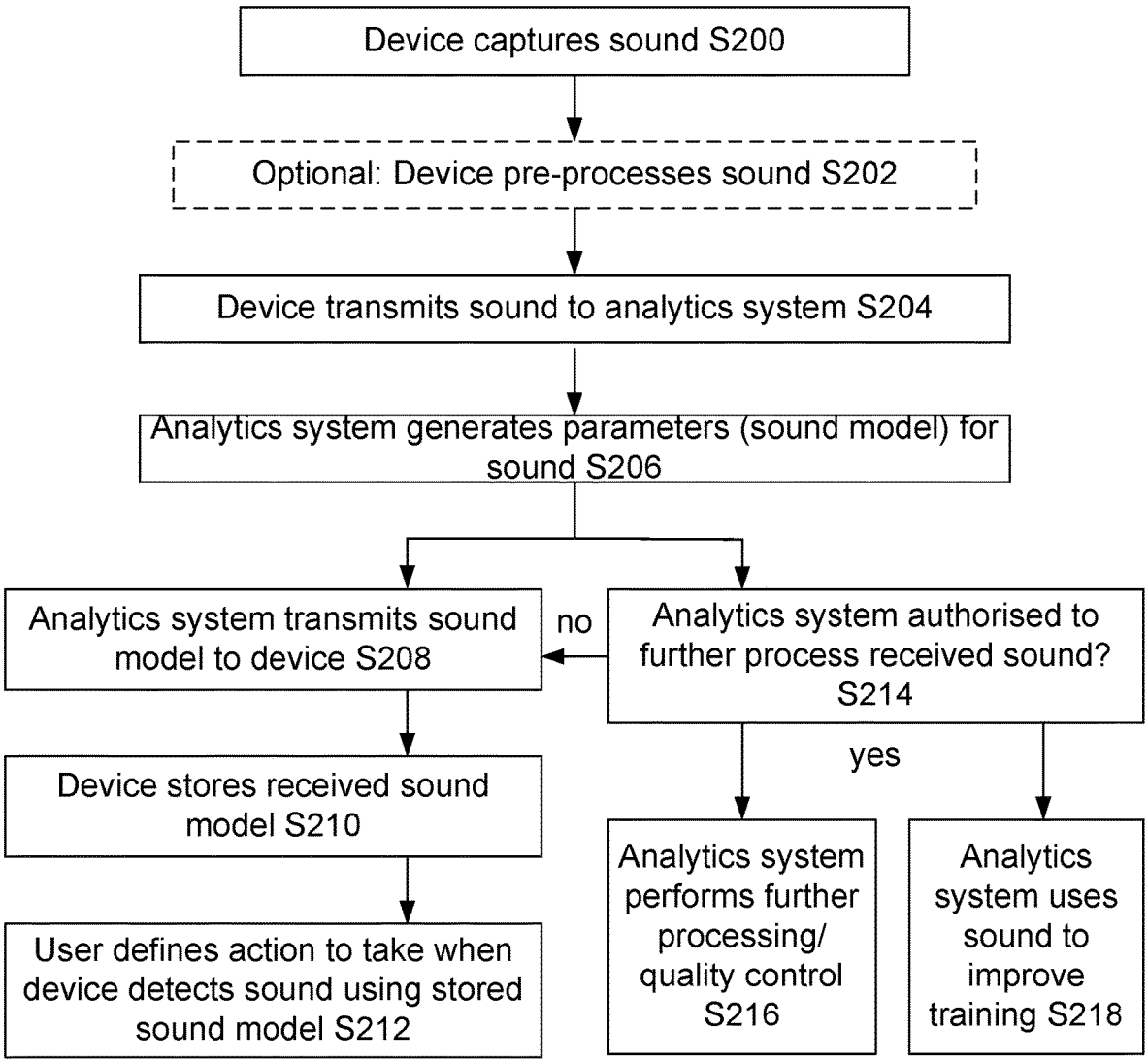
FIG. 2*a* is a flow chart showing example steps of a process to generate a sound model for a captured sound.

FIG. 2*a* is a flow chart showing example steps of a process to generate a sound model for a captured sound, where the sound analysis and sound model generation is performed in a system/device remote to the device which captures the sound. A device, such as device 12 in FIG. 1*a*, captures a sound (S200) and transmits the captured sound to a remote analytics system (S204). As mentioned earlier, the analytics system may be provided in a remote server, or a network of remote servers hosted on the Internet (e.g. in the Internet cloud), or in a device/system provided remote to the device which captures the sound. For example, the device may be a computing device in a home or office environment, and the analytics system may be provided within a separate device within the same environment, or may be located outside that environment and accessible via the Internet.

Preferably, the same sound is captured more than once by the device in order to improve the reliability of the sound model generated of the captured sound. The device may prompt the user to, for example, play a sound (e.g. ring a doorbell, test their smoke alarm, etc.) multiple times (e.g. three times), so that it can be captured multiple times. The device may perform some simple analysis of the captured sounds to check that the same sound has been captured, and if not, may prompt the user to play the sound again so it can be recaptured.

Optionally, the device may pre-process the captured sound (S202) before transmission to the analytics system. The pre-processing may be used to compress the sound, e.g. using a modified discrete cosine transform, to reduce the amount of data being sent to the analytics system.

The analytics system processes the captured sound(s) and generates parameters for the specific captured sound (S206). The sound model generated by the analytics system comprises these generated parameters and other data which can be used to characterise the captured sound. The sound model is supplied to the device (S208) and stored within the device (S210) so that it can be used to identify detected sounds. Preferably, a user defines an action to take when a particular sound is identified, such that the action is associated with a sound model (S212). For example, a user may specify that if a smoke alarm is detected, the device sends a message to a user's phone and/or to the emergency services. Another example of a user specified action is to send a message to or place a call to the user's phone in response to the detection of the user's doorbell. This may be useful if the user is in his garden or garage and out of earshot of his doorbell.

A user may be asked if the captured sound can be used by the analytics system to improve the models and analytics used to generate sound models. If the user has provided approval (e.g. on registering to use the analytics system), the analytics system performs further processing of the captured sounds and/or performs quality control (S216). The analytics system may also use the captured sounds received from each device coupled to the system to improve model generation, e.g. by using the database of sounds a training for other sound models (S218). The analytics system may itself generate sound packs, which can be downloaded/obtained by users of the system, based on popular captured sounds.

In the example implementations shown in FIGS. 1*b* and 1*c*, all of steps S200 to S212 are instead performed on the device which captures the sound. In these example implementations, the captured sounds and locally generated sound models may be sent to the analytics system for further analysis/quality control (S216) and/or to improve the software/analysis techniques used to generate sound models (S218). The improved software/analysis techniques are sent back to the device which generates sound models.

Preferably, the user defines an action for each captured sound for which a model is generated from a pre-defined list. The list may include options such as "send an SMS message", "send an email", "call a number", "contact the emergency services", "contact a security service", which may further require a user to specify a phone number or email address to which an alert is sent. Additionally or alternatively, the action may be to provide a visual indication on the device itself, e.g. by displaying a message on a screen on the device and/or turning on or flashing a light or other indicator on the device, and/or turning on an alarm on the device, etc.

There are a number of ways a sound model for a captured sound can be generated. The analytics system may use a statistical Markov model for example, where the parameters generated to characterise the captured sound are hidden Markov model (HMM) parameters. Additionally or alternatively, the sound model for a captured sound may be generated using machine learning techniques or predictive modelling techniques such as: neural networks, support vector machine (SVM), decision tree learning, etc.

The applicant's PCT application WO2010/070314, which is incorporated by reference in its entirety, describes in detail various methods to identify sounds. Broadly speaking an input sample sound is processed by decomposition into frequency bands, and optionally de-correlated, for example, using PCA/ICA, and then this data is compared to one or more Markov models to generate log likelihood ratio (LLR) data for the input sound to be identified. A (hard) confidence threshold may then be employed to determine whether or not a sound has been identified; if a "fit" is detected to two or more stored Markov models then preferably the system picks the most probable. A sound is "fitted" to a model by effectively comparing the sound to be identified with expected frequency domain data predicted by the Markov model. False positives are reduced by correcting/updating means and variances in the model based on interference (which includes background) noise.

Whilst embodiments described herein describe the identification of audio and the creation of sound models as detailed above, it will be appreciated that other methods of audio identification may be used. Furthermore, it will be appreciated that other techniques may be employed to create a sound model.

There are several practical considerations when trying to detect sounds from compressed audio formats in a robust and scalable manner. Where the sound stream is uncompressed to PCM (pulse code modulated) format and then passed to a classification system, the first stage of an audio analysis system may be to perform a frequency analysis on the incoming uncompressed PCM audio data. However, the recently compressed form of the audio may contain a detailed frequency description of the audio, for example where the audio is stored as part of a lossy compression system. By directly utilising this frequency information in the compressed form, i.e., sub-band scanning in an example implementation of the above, a considerable computational saving may be achieved by not uncompressing and then frequency analysing the audio. This may mean a sound can be detected with a significantly lower computational requirement. Further advantageously, this may make the application of a sound detection system more scalable and enable it to operate on devices with limited computational power which other techniques could not operate on.

The digital sound identification system may comprise discrete cosine transform (DCT) or modified DCT coefficients. The compressed audio data stream may be an MPEG standard data stream, in particular an MPEG 4 standard data stream.

The sound identification system may work with compressed audio or uncompressed audio. For example, the time-frequency matrix for a 44.1 KHz signal might be a 1024 point FFT with a 512 overlap. This is approximately a 20 milliseconds window with 10 millisecond overlap. The resulting 512 frequency bins are then grouped into sub bands, or example quarter-octave ranging between 62.5 to 8000 Hz giving 30 sub-bands.

A lookup table is used to map from the compressed or uncompressed frequency bands to the new sub-band representation bands. For the sample rate and STFT size example given the array might comprise of a (Bin size÷2)×6 array for each sampling-rate/bin number pair supported. The rows correspond to the bin number (centre)—STFT size or number of frequency coefficients. The first two columns determine the lower and upper quarter octave bin index numbers. The following four columns determine the proportion of the bins magnitude that should be placed in the corresponding quarter octave bin starting from the lower quarter octave defined in the first column to the upper quarter octave bin defined in the second column. e.g. if the bin overlaps two quarter octave ranges the 3 and 4 columns will have proportional values that sum to 1 and the 5 and 6 columns will have zeros. If a bin overlaps more than one sub-band more columns will have proportional magnitude values. This example models the critical bands in the human auditory system. This reduced time/frequency representation is then processed by the normalisation method outlined. This process is repeated for all frames incrementally moving the frame position by a hop size of 10 ms. The overlapping window (hop size not equal to window size) improves the time-resolution of the system. This is taken as an adequate representation of the frequencies of the signal which can be used to summarise the perceptual characteristics of the sound. The normalisation stage then takes each frame in the sub-band decomposition and divides by the square root of the average power in each sub-band. The average is calculated as the total power in all frequency bands divided by the number of frequency bands. This normalised time frequency matrix is the passed to the next section of the system where its mean, variances and transitions can be generated to fully characterise the sound's frequency distribution and temporal trends. The next stage of the sound characterisation requires further definitions. A continuous hidden Markov model is used to obtain the mean, variance and transitions needed for the model. A Markov model can be completely characterised by $\lambda=(A,B,\Pi)$ where A is the state transition probability matrix, B is the observation probability matrix and $\Pi$ is the state initialisation probability matrix. In more formal terms:

$$A=\lfloor a_{ij}\rfloor \text{ where } a_{ij}\equiv P(q_{t+1}=S_j|q_t=S_i)$$

$$B=\lfloor b_j(m)\rfloor \text{ where } b_j(m)\equiv P(O_t=v_m|q_t=S_j)$$

$$\Pi=[\pi_i] \text{ where } \pi_i\equiv P(q_1=S_i)$$

where q is the state value, O is the observation value. A state in this model is actually the frequency distribution characterised by a set of mean and variance data. However, the formal definitions for this will be introduced later. Generating the model parameters is a matter of maximising the probability of an observation sequence. The Baum-Welch algorithm is an expectation maximisation procedure that has been used for doing just that. It is an iterative algorithm where each iteration is made up of two parts, the expectation $\varepsilon_t(i,j)$ and the maximisation $\gamma_t(i)$. In the expectation part, $\varepsilon_t(i,j)$ and $\gamma_t(i)$, are computed given $\lambda$, the current model values, and then in the maximisation $\lambda$ is step recalculated. These two steps alternate until convergence occurs. It has been shown that during this alternation process, $P(O|\lambda)$ never decreases. Assume indicator variables $z_i^t$ as Expectation $$\varepsilon_t(i,j)=\frac{\alpha_t(i)a_{ij}b_j(O_{t+1})\beta_{t+1}(j)}{\sum_k\sum_l \alpha(k)a_{kl}b_l(O_{t+1})\beta_{t+1}(l)}$$

$$\gamma_t(i)=\sum_{j=1}^{N}\varepsilon_t(i,j)$$

$$E[z_i^t]=\gamma_t(i) \text{ and } [Z_{ij}^t]=\varepsilon_t(i,j)$$

$$z_i^t=\begin{cases}1 & \text{if } q_t=S_i\\ 0 & \text{otherwise}\end{cases}$$

$$z_{ij}^t=\begin{cases}1 & \text{if } q_t=S_i \text{ and } q_{t+1}=S_j\\ 0 & \text{otherwise}\end{cases}$$

Maximisation $$\hat{a}_{ij}=\frac{\sum_{k=1}^{K}\sum_{t=1}^{T_k-1}\varepsilon_t^k(i,j)}{\sum_{k=1}^{K}\sum_{t=1}^{T_k-1}\gamma_t^k(i)}$$

$$\hat{b}_j(m)=\frac{\sum_{k=1}^{K}\sum_{t=1}^{T_k-1}\gamma_t^k(j)1(O_t^k=v_m)}{\sum_{k=1}^{K}\sum_{t=1}^{T_k-1}\gamma_t^k(j)}$$

$$\hat{\pi}=\frac{\sum_{k=1}^{K}\gamma_1^k(i)}{K}$$

Gaussian mixture models can be used to represent the continuous frequency values, and expectation maximisation equations can then be derived for the component parameters (with suitable regularisation to keep the number of parameters in check) and the mixture proportions.

Assume a scalar continuous frequency value, $O_t \in \Re$ with a normal distribution $$p(O_t|q_t=S_j,\lambda)\sim N(\mu_j,\sigma_j^2)$$

This implies that in state $S_j$, the frequency distribution is drawn from a normal distribution with mean $\mu_j$ and variance $\sigma_j^2$. The maximisation step equation is then $$\hat{\mu}_j = \frac{\sum_t \gamma_t(j) O_t}{\sum_t \gamma_t(j)}$$

$$\hat{\sigma}_j^2 = \frac{\sum_t \gamma_t(j)(O_{t-1} - \hat{\mu}_j)^2}{\sum_t \gamma_t(j)}$$

The use of Gaussians enables the characterisation of the time-frequency matrix's features. In the case of a single Gaussian per state, they become the states. The transition matrix of the hidden Markov model can be obtained using the Baum-Welch algorithm to characterise how the frequency distribution of the signal change over time.

The Gaussians can be initialised using K-Means with the starting points for the clusters being a random frequency distribution chosen from sample data.

To classify new sounds and adapt for changes in the acoustic conditions, a forward algorithm can be used to determine the most likely state path of an observation sequence and produce a probability in terms of a log likelihood that can be used to classify and incoming signal. The forward and backward procedures can be used to obtain this value from the previously calculated model parameters. In fact only the forward part is needed. The forward variable $\alpha_t(i)$ is defined as the probability of observing the partial sequence $\{O_1 K\ O_t\}$ until time t and being in $S_i$ at time t, given the model $\lambda$.

$$\alpha_t(i) \equiv P(O_1 K\ O_t, q_t=S_i|\lambda)$$

This can be calculated by accumulating results and has two steps, initialisation and recursion. $\alpha_t(i)$ explains the first t observations and ends in state $S_i$. This is multiplied by the probability $a_{ij}$ of moving to state $S_j$, and because there are N possible previous states, there is a need to sum over all such possible previous $S_i$. The term $b_j(O_{t+1})$ is then the probability of generating the next observation, frequency distribution, while in state $S_j$ at time t+1. With these variables it is then straightforward to calculate the probability of a frequency distribution sequence.

$$P(O|\lambda) = \sum_{i=1}^{N} \alpha_T(i)$$

Computing $\alpha_t(i)$ has order $O(N^2T)$ and avoids complexity issues of calculating the probability of the sequence. The models will operate in many different acoustic conditions and as it is practically restrictive to present examples that are representative of all the acoustic conditions the system will come in contact with, internal adjustment of the models will be performed to enable the system to operate in all these different acoustic conditions. Many different methods can be used for this update. For example, the method may comprise taking an average value for the sub-bands, e.g. the quarter octave frequency values for the last T number of seconds. These averages are added to the model values to update the internal model of the sound in that acoustic environment.

3. Identify Detected Sounds

Figure 2B:
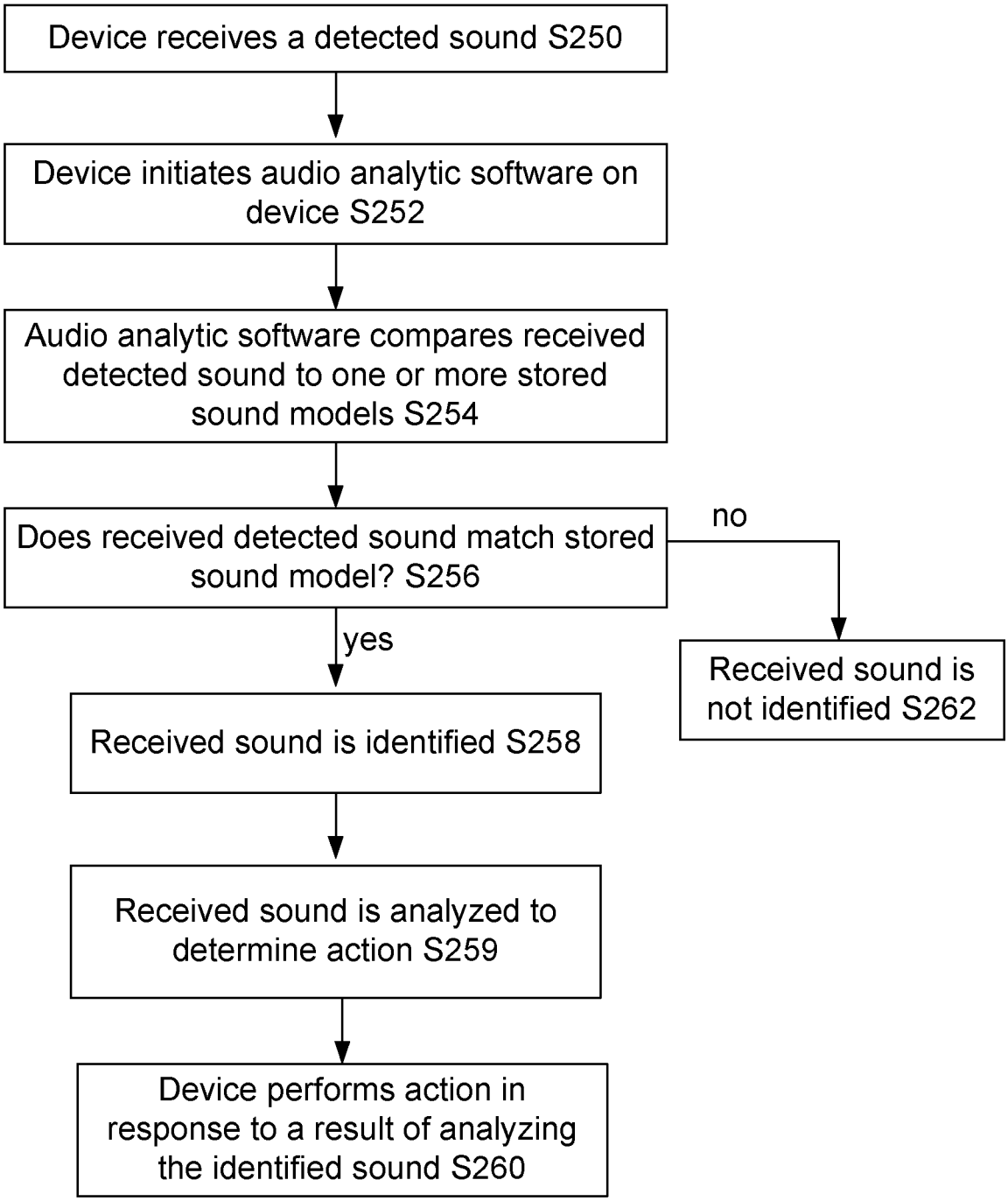
FIG. 2*b* is a flow chart showing example steps of a process to identify a detected sound using a sound model.

FIG. 2*b* is a flow chart showing example steps of a process to identify a detected sound using a sound model. A device receives a detected sound (S250), either via its own sound capture module (e.g. a microphone and associated software), or from a separate device. The device initiates audio analytics software stored on the device (S252) in order to analyse the detected sound. The audio analytics software identifies the detected sound by comparing it to one or more sound models stored within the device (S254). If the detected sound matches one of the stored sound models (S256), then the sound is identified (S258). The received sound is then analysed to determine an action (S259), and then the device performs an action in response to a result of analysing the identified sound (S260). For example, the device may be configured to perform DRC, and/or dynamic compression, and/or to steer reproduced sound or a channel of the reproduced sound, all as previously described, for example based upon an averaged spectrum, or compressed sensing, and/or based on an estimated location of a sound (determined, using multiple microphones, for example from triangulation). If the detected sound does not match one of the stored sound models, then the detected sound is not identified (S262) and the process terminates. This means that in an environment such as a home, where many different sounds may be detected, only those sounds which the user has specifically captured (and for which sound models are generated) can be detected.

The device is preferably configured to detect more than one sound at a time. In this case, the device will run two analytics functions simultaneously. An indication of each sound detected and identified may be provided to the user.

4. Example Systems

Figure 3:
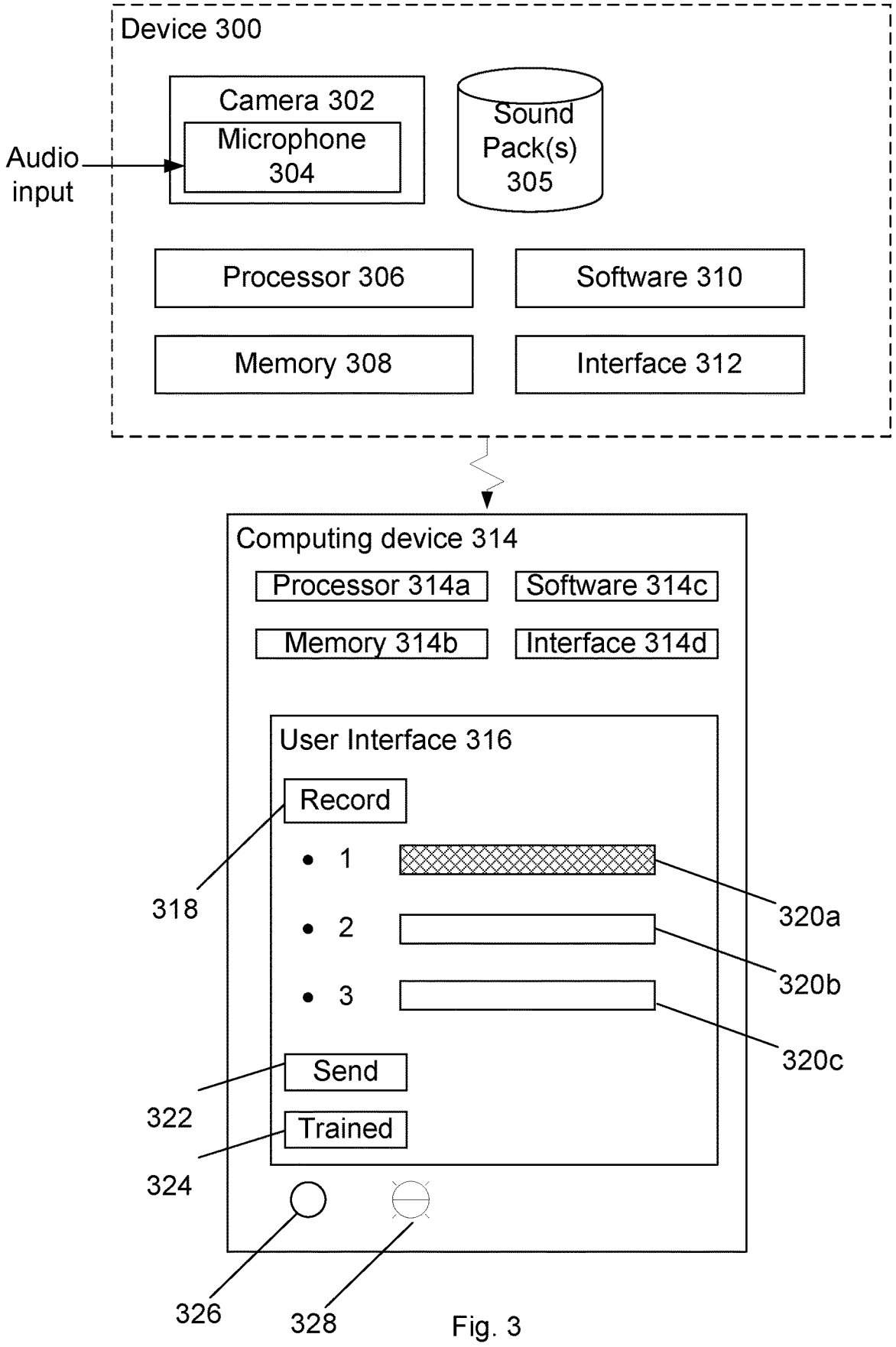
FIG. 3 is a block diagram showing a specific example of a system to capture and identify sounds.

FIG. 3 is a block diagram showing an example of a system to capture and identify sounds. The system comprises a device 300 which is used to capture sounds and identify sounds. The device 300 can be used to capture more than one sound and to store the sound models associated with each captured sound. The device comprises a processor 306 coupled to memory 308 storing computer program code 310 to implement the sound capture and sound identification, and to interfaces 312 such as a network interface. A wireless interface, for example a Bluetooth®, Wi-Fi or near field communication (NFC) interface is provided for interfacing with a computing device 314.

The device 300 comprises a security camera 302 and a sound capture module or microphone 304. The device 300 comprises a data store 305 storing one or more sound models (or "sound packs"). In example implementations, the sound model for each captured sound is generated in a remote sound analytics system (not shown), such that a captured sound is sent to the remote analytics system for processing. In this illustrated example implementation, the device 300 is configured to capture sounds in response to commands received from a computing device 314, which is coupled to the device. The computing device 314 may be a user device such as a PC, mobile computing device, smartphone, laptop, tablet-PC, home automation panel, etc. Sounds captured by the microphone 304 are transmitted to the computing device 314, and the computing device 314 sends these to a remote analytics system for analysis. The remote analytics system returns a sound model for the captured sound to the device 314, and the device 314 provides this to the device 300 for storage in the data store 305. This has an advantage that the device which captures and identifies sounds, and the device 314 which is coupled to the analytics system, do not require the processing power or any specific software to analyse sounds and generate sound models. Another advantage is that the device 300 stores the sound models locally (in data store 305) and so does not need to be in constant communication with the remote system or with the computing device 314 in order to identify a detected sound.

The computing device 314 may be a user device such as a PC, mobile computing device, smartphone, laptop, tablet-PC, home automation panel, etc., and comprises a processor 314*a*, a memory 314*b*, software to perform the sound capture 314*c* and one or more interfaces 314*d*. The computing device 314 may be configured to store user-defined or user-selected actions which are to be taken in response to the identification of a particular sound. A user interface 316 on the computing device 314 enables the user to perform the sound capture and to select actions to be taken in association with a particular sound. The user interface 316 shown here is a display screen (which may be a touchscreen) which, when the sound capture software is running on the device 314, displays a graphical user interface to lead the user through a sound capture process. For example, the user interface may display a "record" button 318 which the user presses when they are ready to capture a sound via the microphone 304. The user preferably presses the record button 318 at the same time as playing the sound to be captured (e.g. a doorbell or smoke alarm). In this illustrated example, the user is required to play the sound and record the sound three times before the sound is sent to a remote analytics system for analysis. A visual indication of each sound capture may be displayed via, for example, progress bars 320*a*, 320*b*, 320*c*. Progress bar 320*a* is shown as hatched here to indicate how the progress bar may be used to show the progress of the sound capture process—here, the first instance of the sound has been captured, so the user must now play the sound two more times.

Once the sounds have been captured successfully, the user interface may prompt the user to send the sounds to the remote analytics system, by for example, displaying a "send" button 322 or similar. Clicking on the send button causes the computing device 314 to transmit the recorded sounds to the remote system. When the remote system has analysed the sound and returned a sound pack (sound model) to the device 314, the user interface may be configured to display a "trained" button 324 or provide a similar visual indication that a sound model has been obtained. Preferably, the sound pack is sent by the device 314 to the device and used by the device to identify sounds, as this enables the device to detect and identify sounds without requiring constant communication with the computing device 314. Alternatively, sounds detected by the device microphone 304 may be transmitted to the computing device 314 for identification. When a sound has been identified by the device, it may send a message to the computing device 314 to alert the device to the detection. Additionally, the device may perform a user-defined action in response to the identification. For example, the camera 302 may be swivelled into the direction of the identified sound.

The device 314 comprises one or more indicators, such as LEDs. Indicator 326 may be used to indicate that the device has been trained, i.e. that a sound pack has been obtained for a particular sound. The indicator may light up or flash to indicate that the sound pack has been obtained. This may be used instead of the trained button 324. Additionally or alternatively, the device 314 may comprise an indicator 328 which lights up or flashes to indicate that a sound has been identified by the device.

Figure 4:
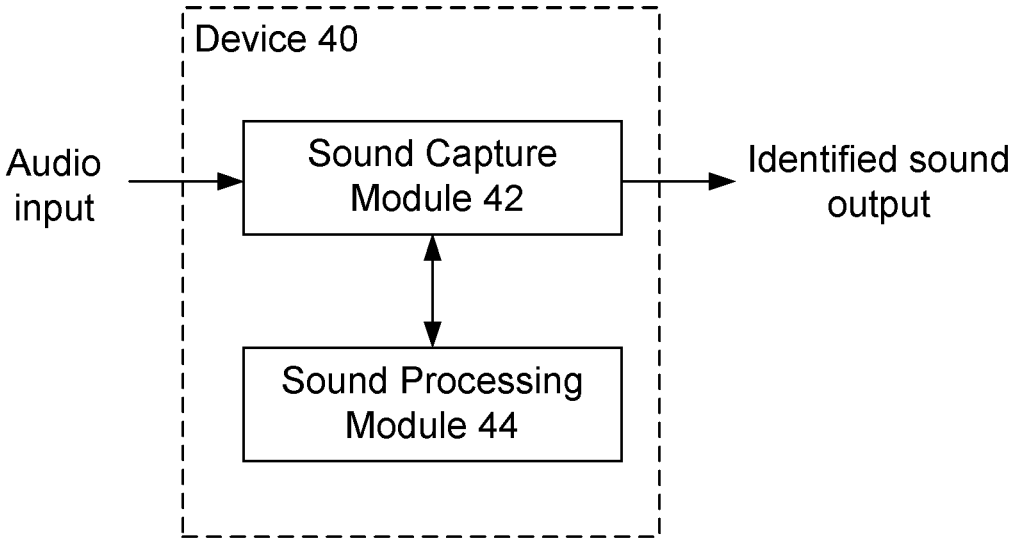
FIG. 4 shows a schematic of a system configured to capture and identify sounds.

FIG. 4 shows a schematic of a device configured to capture and identify sounds. As described earlier with reference to FIGS. 1*a* to 1*c*, a device 40 may be used to perform both the sound capture and the sound processing functions, or these functions may be distributed over separate modules. Thus, one or both of a sound capture module 42, configured to capture sounds, and a sound processing module 44, configured to generate sound models for captured sounds, may be provided in a single device 40, or as separate modules which are accessible by device 40. The sound capture module 42 may comprise analytics software to identify captured/detected sounds, using the sound models generated by the sound processing module 44. Thus, audio detected by the sound capture module 42 is identified using sound models generated by module 44, which may be within device 40 or remote to it.

Device 40 may be part of a smart speaker or other smart device configured to capture and identify sounds. The smart device preferably comprises a sound capture module (e.g. a microphone), means for communicating with an analytics system that generates a sound model, and analytics software to compare detected sounds to the sound models stored within the device 46. The analytics system may be provided in a remote system, or if the smart device has the requisite processing power, may be provided within the device itself. The smart device comprises a communications link to other devices (e.g. to other user devices) and/or to the remote analytics system. The smart device may be battery operated or run on mains power.

Figure 5:
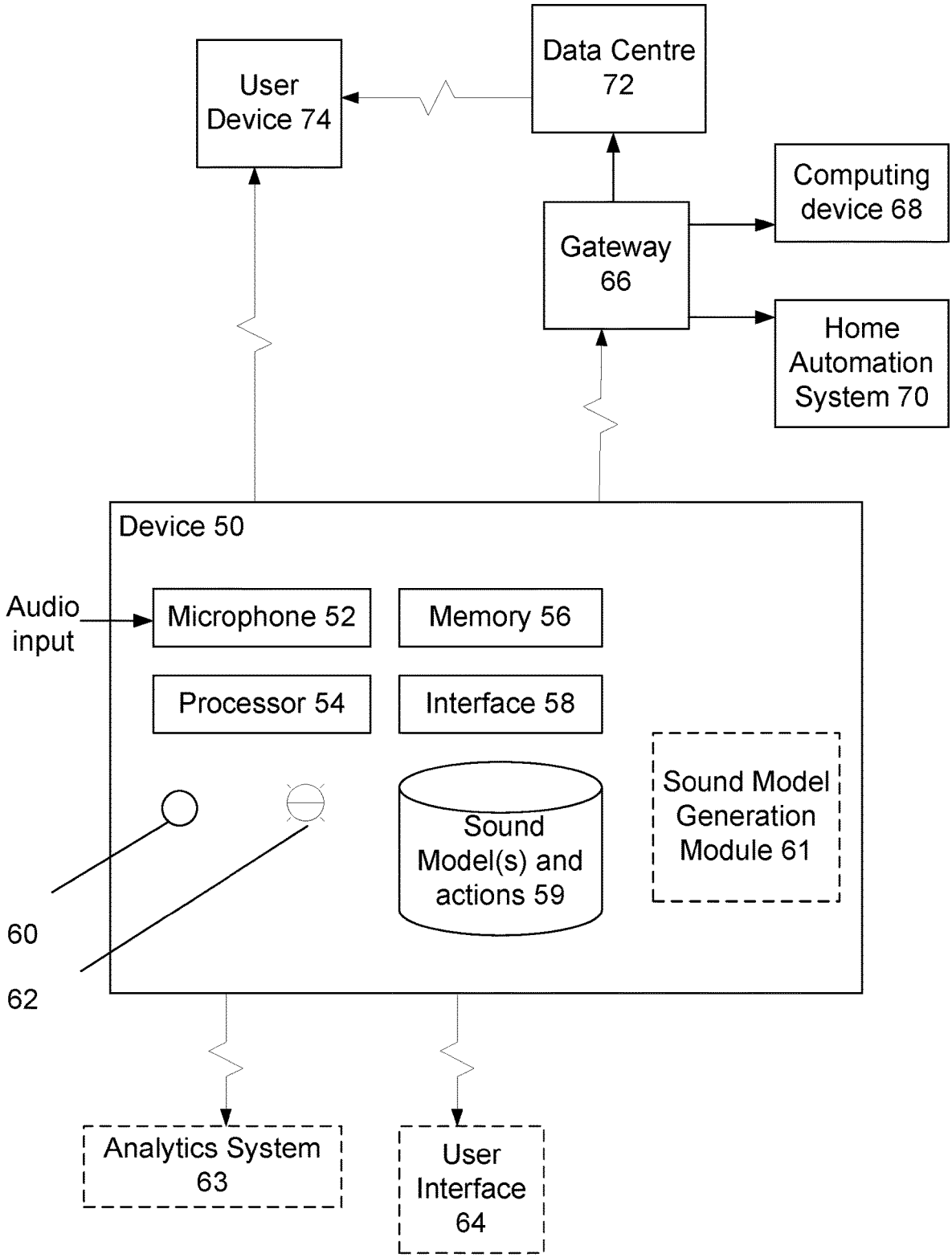
FIG. 5 is a block diagram showing another specific example of a system used to capture and identify sounds.

FIG. 5 is a block diagram showing another specific example of a device used to capture and identify sounds. The system comprises a device 50 which is used to capture sounds and identify sounds. For example, the device 50 may be the smart device described above. The device 50 comprises a microphone 52 which can be used to capture sounds and to store the sound models associated with each captured sound. The device further comprises a processor 54 coupled to memory 56 storing computer program code to implement the sound capture and sound identification, and to interfaces 58 such as a network interface. A wireless interface, for example a Bluetooth®, Wi-Fi or near field communication (NFC) interface is provided for interfacing with other devices or systems.

The device 50 comprises a data store 59 storing one or more sound models (or "sound packs"). In example implementations, the sound model for each captured sound is generated in a remote sound analytics system 63, such that a captured sound is sent to the remote analytics system for processing. Alternatively, the sound model may be generated by a sound model generation module 61 within the device 50. In this illustrated example implementation, the device 50 is configured to capture sounds in response to commands received from a user. The device 50 comprises one or more interfaces to enable a user to control to the device to capture sounds and obtain sound packs. For example, the device comprises a button 60 which a user may depress or hold down to record a sound. A further indicator 62, such as an LED, is provided to indicate to the user that the sound has been captured, and/or that further recordings of the sound, and/or that the sound can be transmitted to the analytics system 63 (or sound model generation module 61). The indicator 62 may flash at different rates or change colour to indicate the different stages of the sound capture process.

The indicator 62 may indicate that a sound model has been generated and stored within the device 50.

The device 50 may be configured to implement any/all of the techniques described above. Additionally or alternatively it may in example implementations comprise a user interface, which may be a voice interface, to enable a user to select an action to associate with a particular sound or speech command. Alternatively, the device 50 may be coupled to a separate user interface 64, e.g. on a computing device or user device, to enable this function. When a sound has been identified by device 50, it may send a message to a user device 74 (e.g. a computing device, phone or smartphone) coupled to device 50 to alert the user to the detection, e.g. via Bluetooth® or Wi-Fi. Additionally or alternatively, the device 50 is coupled to a gateway 66 to enable the device 50 to send an SMS or email, order shopping, download or stream music, answer questions, and so forth.

Optionally device 50 may perform additional functions. For example, a user of device 50 may specify for example, an action to be taken in response to a smoke alarm being detected or in response to the sound of a doorbell ringing. Thus the device 50 may configured to communicate with a home automation system 70 via the gateway, such that the home automation system 70 can perform household functions.

Figure 6:
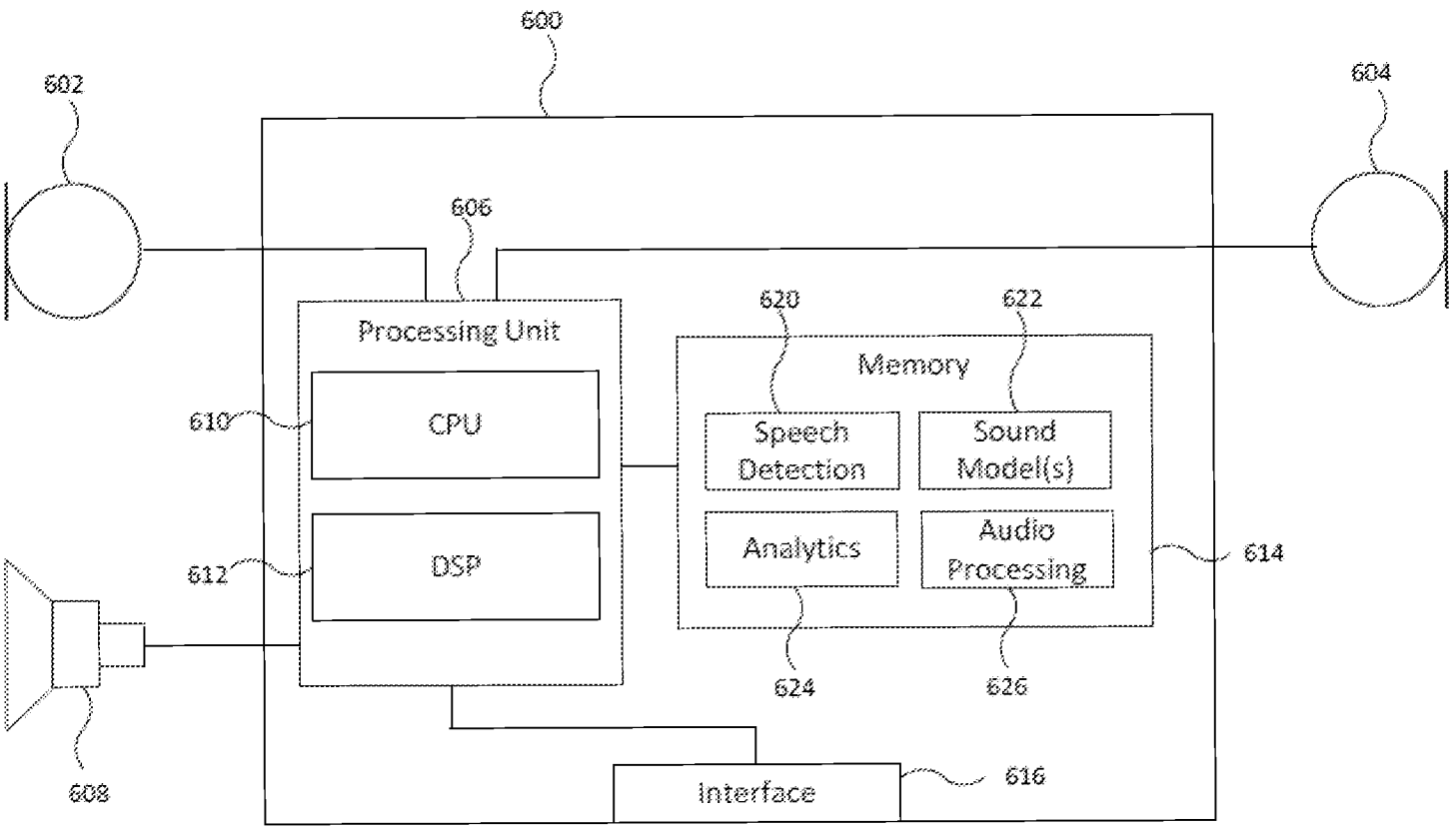
FIG. 6 shows a block diagram of an audio device.

FIG. 6 shows another block diagram of an audio signal processing device which may be used to implement examples of the techniques described in the summary section. The device may be a smart or portable speaker, but may also be any other electronic device. The device comprises a processing unit 606 coupled to program memory 614.

The device 600 comprises at least one microphone 602, configured to capture audio from the environment, and preferably at least one other microphone 604. Both the inner microphone 602 and the outer microphone 604 are connected to the processing unit 606. There is also at least one speaker, 608 which is also connected to the processing unit 606. The processing unit 606 may comprise a CPU 610 and/or a DSP 612. The CPU 610 and DSP 612 may further be combined into one unit.

The device 600 may comprise an interface 616, which may be used to interact with the system and/or which provides wired or wireless communications for receiving audio to be played and/or voice commands. The interface is connection to the processing unit 606.

The memory 614 may comprise a speech detection module 620, optionally a stored sound module 622, optionally an analytics module 624 and an audio processing module 626 (sound recognition may be performed remotely and the results provided back to the device). The speech detection module 620 contains code that when run on the processing unit 606 (e.g. on CPU 610 and/or a DSP 612), configures the processing unit 606 to recognize sound in an audio signal that has been received by the at least one microphone 602 and/or the at least one other microphone 604. Sound model module 622 may store sound models that are used in processes, including but not limited to, the identification of a sound or a sound context. The analytics module 624 may contain code that when run on the processing unit 606 (e.g. on CPU 610 and/or a DSP 612), configures the processing unit 606 to perform analysis, for example comparing a sound to a sound model to identify a detected sound model. The audio processing module 626 contains code that when run on the processing unit 606 (e.g. on CPU 610 and/or a DSP 612), configures the processing unit 606 to perform processing on audio signals received by the microphone(s) 602, 604. The processing which may be included has been described above.

The skilled person will appreciate that although some sound recognition techniques have been described may alternative techniques are available and may successfully be employed. No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A method of digital room correction for a device including a loudspeaker, the method comprising:

capturing audio, using one or more microphones associated with the device, from an environment local to the device;

processing the captured audio to recognize one or more categories of sound; and in response to recognizing the one or more categories of sound:

controlling, by the device, a digital room correction procedure comprising determining a room response correction dependent upon analyzing captured audio associated with the at least one of the categories of sound, the analyzing comprising characterizing a modification of the captured audio caused by the environment local to the device.

2. A method as claimed in claim 1 wherein recognized categories of sound include one or more categories selected from the group consisting of: speech, music, human activities, background room sounds; or sub-categories thereof.

3. A method as claimed in claim 1 wherein the controlling comprises suppressing operation of the digital room correction.

4. A method as claimed in claim 1 wherein controlling the digital room correction procedure comprises determining the room response correction from captured audio for the at least one recognized category of sound, optionally in combination with a priori knowledge of characteristics of the at least one recognized category of sound.

5. A method as claimed in claim 1 wherein determining the room response correction comprises selecting from a set of predetermined response corrections selected responsive to i) the at least one recognized category of sound and ii) the captured audio for the at least one recognized category of sound.

6. A method as claimed in claim 1 wherein determining the room response correction comprises comparing a set of parameters of the captured audio for the at least one recognized category of sound with corresponding expected parameters for the at least one recognized category of sound.

7. A method of controlling sound generation by a device including a loudspeaker, the method comprising:

capturing audio, using one or more microphones associated with the device, from an environment local to the device;

inputting a play audio data stream representing audio to be played by the device;

generating sound from the device according to the play audio modified by a speaker response;

processing the captured audio to recognize one or more categories of sound; and in response to recognizing the one or more categories of sound:

adjusting the speaker response by controlling a digital room correction comprising determining a room response correction dependent upon analyzing captured audio associated with the at least one of the categories of sound, the analyzing comprising characterizing a modification of said captured audio caused by the environment local to the device.

8. A method as claimed in claim 7 further comprising determining one or more characteristics of audio represented by the play audio data stream; and wherein said adjusting comprises adjusting the speaker response dependent upon recognition of the at least one categories of sound and the one or more characteristics.

9. A method as claimed in claim 7 wherein the adjusting comprises adjusting a dynamic compression response of the speaker.

10. A method as claimed in claim 7 further comprising determining a perceptual masking of the play audio data stream by captured audio; and adjusting the speaker response dependent upon a predicted perceptual masking of the audio represented by the play audio data stream.

11. A method as claimed in claim 10 further comprising controlling power consumption by a speaker driver and/or loudspeaker of the device in response to said predicted perceptual masking.

12. A non-transitory data carrier carrying processor control code to implement the method of claim 1.

13. An electronic device or system comprising:

an input to receive play audio data for reproduction;

one or more loudspeakers to reproduce the play audio data;

one or more microphones to capture audio from the local environment;

a processor, coupled to the input, microphone and loudspeaker, to working memory, and to program memory storing processor control code comprises code to implement the method of claim 1.

14. A method of digital room correction for a device including a loudspeaker, the method comprising:

capturing audio, using one or more microphones associated with the device, from an environment local to the device;

processing the captured audio to recognize one or more categories of sound; and in response to recognizing the one or more categories of sound:

controlling, by the device, a digital room correction procedure dependent upon recognition at of least one of the categories of sound and/or analysis of captured audio associated with the at least one of the categories of sound, wherein the controlling the digital room correction comprises at least one of:

suppressing operation of the digital room correction; and adjusting audio played by the loudspeaker of the device comprising modifying frequencies and/or times of sounds generated by the device in response to a determination that said frequencies and/or times are predicted to require modification based on environmental audio from the environment local to the device.

* * * * *